US008898996B2

(12) United States Patent
Garzon et al.

(10) Patent No.: US 8,898,996 B2
(45) Date of Patent: Dec. 2, 2014

(54) METHOD FOR FORMING A RETAINING WALL, AND CORRESPONDING RETAINING WALL

(71) Applicants: Maurice Garzon, Montreal (CA); Lavih Garzon, Pierrefonds (CA)

(72) Inventors: Maurice Garzon, Montreal (CA); Lavih Garzon, Pierrefonds (CA)

( * ) Notice: Subject to any disclaimer, the term of this patent is extended or adjusted under 35 U.S.C. 154(b) by 0 days.

(21) Appl. No.: 13/821,153

(22) PCT Filed: Sep. 27, 2012

(86) PCT No.: PCT/CA2012/050676

§ 371 (c)(1),
(2), (4) Date: Mar. 6, 2013

(87) PCT Pub. No.: WO2013/044386

PCT Pub. Date: Apr. 4, 2013

(65) Prior Publication Data

US 2014/0215959 A1 Aug. 7, 2014

Related U.S. Application Data

(60) Provisional application No. 61/611,085, filed on Mar. 15, 2012, provisional application No. 61/539,547, filed on Sep. 27, 2011.

(51) Int. Cl.

| | |
|---|---|
| ***E02D 3/02*** | (2006.01) |
| ***E02D 29/02*** | (2006.01) |
| ***E02D 3/046*** | (2006.01) |
| ***E02D 27/26*** | (2006.01) |

(52) U.S. Cl.

CPC ..... *E02D 29/0275* (2013.01); *E02D 3/046* (2013.01); *E02D 27/26* (2013.01)

USPC ..... 52/742.14; 52/741.11; 52/169.1; 405/271; 405/287

(58) Field of Classification Search

CPC ..... E02D 29/02; E02D 29/0275; E02D 3/046; E02D 27/26; E02D 17/04

USPC ..... 52/741.11, 741.13, 742.1, 742.13, 52/742.14, 169.1, 292, 294; 405/267, 268, 405/271, 282, 284, 286, 287, 259.1

See application file for complete search history.

(56) References Cited

U.S. PATENT DOCUMENTS

| | | | |
|---|---|---|---|
| 1,650,827 | A | 1/1927 | Friz |
| 2,298,837 | A | 3/1941 | Oswald |

(Continued)

FOREIGN PATENT DOCUMENTS

| | | |
|---|---|---|
| CA | 2501773 | 9/2006 |
| CN | 101139838 | 3/2008 |

(Continued)

OTHER PUBLICATIONS

International Search Report and Written Opinion, mailed Jan. 9, 2013, which issued in corresponding International Application No. PCT/CA2012/050676.

*Primary Examiner* — Brent W Herring

(74) *Attorney, Agent, or Firm* — Fish & Richardson P.C.

(57) ABSTRACT

A method for forming a cementitious retaining wall is described. The method includes the step of defining on an earth surface an outline of the wall to be formed. The outline delimits an area of earth to be excavated. The method also includes the step of compacting the area. After compaction, the earth underneath and adjacent to the area is densified, which provides stability to the earth during excavation and after the wall is formed. The method also includes the step of excavating the earth from the area compacted to an initial depth, thereby creating a wall cavity. The method further includes the step of compacting the bottom surface of the wall cavity and subsequently excavating the earth from the compacted bottom surface. This step can be repeated as much as required, under a final depth of the wall cavity is reached. Once the final depth is reached, the wall cavity can be filled at least partially a cementitious material so as to form the retaining wall.

15 Claims, 21 Drawing Sheets

(56) References Cited

U.S. PATENT DOCUMENTS

| | | | | |
|---|---|---|---|---|
| 3,898,844 | A | 8/1975 | Menard | |
| 4,343,571 | A * | 8/1982 | Price | 405/284 |
| 4,504,176 | A * | 3/1985 | Lindberg et al. | 405/271 |
| 4,557,634 | A * | 12/1985 | Vidal | 405/286 |
| 4,818,142 | A | 4/1989 | Cochran | |
| 5,112,161 | A * | 5/1992 | Trevisani | 405/267 |
| 5,139,369 | A * | 8/1992 | Jaecklin | 405/262 |
| 5,193,324 | A | 3/1993 | Fellows | |
| 6,079,909 | A * | 6/2000 | Elmore et al. | 405/284 |
| 6,280,121 | B1 * | 8/2001 | Khamis | 405/284 |
| 7,114,887 | B1 | 10/2006 | Rainey | |
| 7,125,202 | B2 * | 10/2006 | Morizot et al. | 405/262 |
| 7,249,916 | B2 | 7/2007 | Klyne | |
| 7,661,907 | B2 * | 2/2010 | Armstrong | 405/271 |
| 8,011,859 | B2 * | 9/2011 | Freitag et al. | 405/262 |
| 2006/0216120 | A1 | 9/2006 | Klyne | |
| 2007/0286688 | A1 * | 12/2007 | Bradley | 405/276 |
| 2010/0303555 | A1 * | 12/2010 | Herse et al. | 405/286 |
| 2011/0142550 | A1 | 6/2011 | Lee | |
| 2013/0259583 | A1 * | 10/2013 | Maritz et al. | 405/284 |

FOREIGN PATENT DOCUMENTS

| | | |
|---|---|---|
| JP | 60173214 | 9/1985 |
| JP | 60173223 | 9/1985 |
| JP | 2164937 | 6/1990 |
| JP | 4336117 | 11/1992 |
| JP | 6081354 | 3/1994 |
| JP | 10131175 | 5/1998 |
| JP | 2001226968 | 8/2001 |
| JP | 2004092097 | 3/2004 |
| JP | 2005155094 | 6/2005 |
| JP | 2005207144 | 8/2005 |
| WO | 8809849 | 12/1988 |

* cited by examiner

METHOD FOR FORMING A RETAINING WALL, AND CORRESPONDING RETAINING WALL

CROSS REFERENCE TO PRIOR APPLICATIONS

This is a U.S. National Phase application under 35 U.S.C. §371 of International Patent Application No. PCT/CA2012/050676, filed Sep. 27, 2011, and claims the priority of U.S. Provisional Patent Application No. 61/539,547, filed Sep. 27, 2011 and U.S. Provisional Patent Application No. 61/611,085, filed Mar. 15, 2012, all of which are incorporated by reference herein in their entirety.

FIELD OF THE INVENTION

The present invention relates to retaining walls and other such support walls. More specifically, the present invention relates to a method for forming a retaining wall and a correspondingly formed retaining wall.

BACKGROUND OF THE INVENTION

It is known to excavate earth so as to build a structure in the excavation site, or to remove contaminated earth, among other reasons. Before these excavations can occur, however, measures must be taken to secure or "retain" the earth that is adjacent to the excavation site so as to prevent this earth from sliding into the site, interrupting work, and/or other undesirable drawbacks. One such measure used to secure the earth is a retaining wall, which is installed to prevent earth from moving from an area where it is retained, to an area where there is no earth (i.e. the excavated site).

Typically, a retaining wall is a vertically-erected or laterally-stepped wall having one side facing the excavated site, and another side holding back the earth from the site. Multiple retaining walls can be erected around the site, depending on its configuration and requirements. Retaining walls can also be used for preventing fluid from entering an area, such as when used to form the walls of a cofferdam, or to seal or contain a landfill sight, for example.

Once a retaining wall is in place, the forces acting on it, and that it must resist, are the mass of the earth being retained, the mass of any matter on top of the wall, the moment force generated by the earth about the point at which the wall is in the ground. Other forces may also act against the wall (i.e., earth tremors, traffic loads, local vibrational loads, etc.). In known retaining walls, these forces are resisted by the inertial mass of the wall and the friction generated by the soil against the wall. Therefore, the retaining wall must resist both horizontal displacement and rotational moment forces.

Different types of retaining walls, and methods for creating them, are known in the art.

For example, retaining walls formed of sheet piles are known. Sheet piles are typically corrugated sheets of metal, although wood and other material can be used, which interlock or are assembled together to form a retaining wall. Generally speaking, sheet piles must be driven into the earth with an appropriate driving device to a depth that extends far below the final excavation depth when not anchored. A portion of the sheet piles are generally left sticking out of the ground. Once driven into the ground, excavation of the area can occur. Some of the disadvantages associated with the use of sheet piles for creating retaining walls include: a) sheet piles need to be banged or driven into the ground, which can create much noise and prevent the installation of the retaining wall at night due to noise constraints; b) sheet piles are not often self-sustainable or suitable for use in wide or deep retaining walls; c) they do not often provide enough space to insert an anchor when the sheet piles are in the ground and adjacent structures are present on both sides; d) sheet piles often cannot be driven past underground hard rock formations, which means these formations must be broken up by drilling, increasing installation times and costs even more; e) sheet piles are not often suitable for sites in dense urban areas, where there is a need to avoid disturbing the earth near the foundations of adjacent buildings; f) they are not often ideal for forming impervious barriers because there is the possibility of leaking at the junction of sheet piles and corrosion may destroy metal continuity; g) etc.

Also known are retaining walls known as "Berlin" walls or soldier pile walls. These retaining walls are typically formed by driving soldier piles (essentially concrete or steel cylinders or H beams and/or planks) into the ground at regular intervals. Then, excavation is performed to very small depths. Afterwards, the soldier piles are then linked by webbing or lagging, which typically consists of wood or concrete panels, and which holds back the earth from the excavated area. Some of the disadvantages of retaining walls made of soldier piles and/or Berlin walls include: i) they are primarily limited to temporary constructions; ii) as with sheet piles, they are not suitable for being used as an impervious barrier; iii) lagging made of wood can often rot in wet earths over time, thus reducing the ability of the wall to retain earths and potentially generate hazardous bacteria; iv) as with the sheet piles, the driving of the soldier piles can create much noise; v) they require beams and anchors to ensure their stability and may interfere with the building layout; vi) etc.

Another known type of retaining wall includes those made of concrete. U.S. Pat. No. 4,818,142 to COCHRAN relates to a method and apparatus of constructing a walled pool excavation. A method and apparatus are described for forming a cementitious walled ground excavation for receiving a pool.

US patent application US 2011/0142550 A1 to LEE relates to a method for constructing a chair-type, self-supported earth retaining wall. The document describes a method for constructing a chair-type, self-supported earth retaining wall used for retaining external forces such as earth pressure prior to an excavation. A flowable stiffening material is also described.

The following US patent documents also relate to retaining walls and methods for constructing retaining walls or other similar structures: U.S. Pat. No. 7,114,887 B1; U.S. Pat. No. 5,193,324; U.S. Pat. No. 3,898,844; and U.S. Pat. No. 1,650,827.

The following foreign patent documents are also known: JP 2005207144 A; JP 2005155094 A; JP 2001226968 A; JP 10131175 A; JP 06081354 A; JP 04336117 A; JP 02164937 A; JP 60173223 A; JP 60173214 A; and CN 101139838 A.

Some disadvantages associated some of these known retaining walls and methods include: I) they often require very large machinery to prepare the earth for the retaining wall, which can hinder the ability to create a retaining wall on sites more limited workspace; II) the retaining walls so constructed are often relatively thin structures because of the need to minimize the use of concrete or other materials, resulting in additional reinforcement and anchoring being necessary which complicates the construction; III) such walls may not be sufficiently strong to support other structures, vehicles, or equipment; d) etc.

Hence, in light of the aforementioned, there is a need for a method and retaining wall which, by virtue of its steps, design and components, would be able to overcome or at least minimize some of the aforementioned prior art problems.

SUMMARY OF THE INVENTION

According to an aspect of the present invention, there is provided a method for forming a cementitious retaining wall, the method comprising the steps of:

a) defining on an earth surface an outline of the wall to be formed, the outline delimiting an area of earth to be excavated;

b) compacting the area, thereby densifying the earth underneath and adjacent to the area;

c) excavating the earth from the area compacted in step b) to an initial depth, thereby creating a wall cavity, the wall cavity comprising a bottom surface and side surfaces;

d) compacting the bottom surface of the wall cavity and subsequently excavating the earth from the compacted bottom surface;

e) repeating step d) until a final depth of the wall cavity is reached; and f) filling at least part of the wall cavity with a cementitious material so as to form the retaining wall.

In one possible configuration, the compaction performed in step b) is done by applying a vibrational force within a given acceleration range. Such a vibrational force may be applied by using a vibrational plate, which can be attached to a hydraulic circuit. The compaction can also be performed on the earth adjacent to the area of earth to be excavated. This may be suitable, for example, under embankments such as deviations, railroads, and similar structures.

During the excavation in step c), a retention structure, such as a steel caisson, can be used to support the side surfaces of the wall cavity. Such a structure may be installed before or after the excavation, or simultaneously while the excavation is being performed.

The retaining wall formed by the method may have additional, optional, features. For example, the retaining wall can have a top surface which can allow vehicles to circulate thereon, or which can support a structure mounted to it.

According to another aspect of the present invention, there is provided a system for creating a cementitious retaining wall for retaining or sealing an adjacent volume of material, the system comprising:

a compaction device for compacting earth of an area in which the retaining wall will be created, the compaction device increasing earth density and stability;

an excavation device for excavating the area compacted by the compaction device to a predetermined depth; and a filling device for filling the area excavated by the excavation device with a cementitious pour so as to form the cementitious retaining wall.

Optionally, the compaction device may be a hydraulically-driven vibratory plate operating at high frequency. Other vibratory probes or vibro may be used to to minimize the actual earth pressures against the proposed wall.

In other optional configurations, the hardened pour binds a sandwich wall comprising a poured cementitious foundation between a stack of concrete blocks that also serves as a formwork for the interior cementitious pour. Piles, reinforcements, anchors, etc. can be added to the excavated area before or after the pour so as to reinforce and/or stabilize the retaining wall.

The objects, advantages and other features of the method will become more apparent upon reading of the following non-restrictive description of optional configurations thereof, given for the purpose of exemplification only, with reference to the accompanying drawings.

DETAILED DESCRIPTION OF OPTIONAL CONFIGURATIONS

Figure 1:
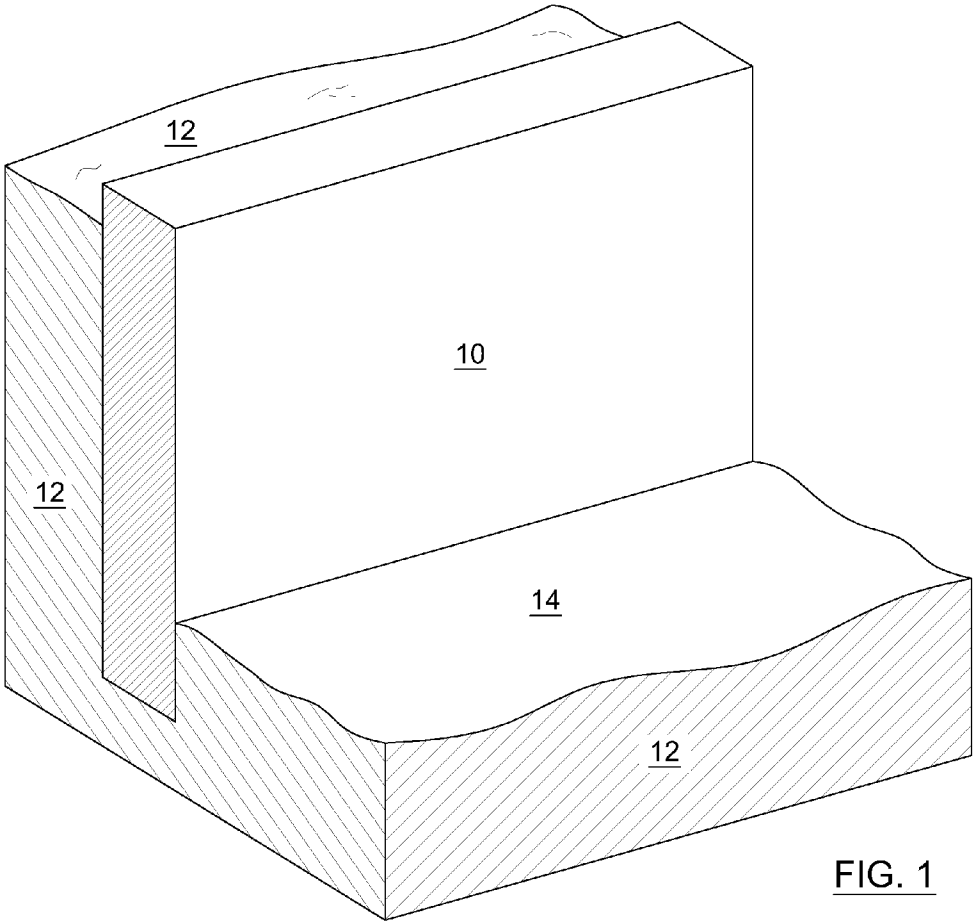
FIG. 1 is a schematic perspective view of a retaining wall within its environment, according to an optional configuration of the invention.

In the following description, the same numerical references refer to similar elements. Furthermore, for sake of simplicity and clarity, namely so as to not unduly burden the figures with several references numbers, not all figures contain references to all the components, steps and features of the method and references to some components, steps and features may be found in only one figure, and components, steps and features of the method illustrated in other figures can be easily inferred therefrom. The implementations, geometrical configurations, materials mentioned and/or dimensions shown in the figures are optional, and given for the purposes of exemplification only.

Moreover, although the method may be used for forming a "cementitious" retaining wall, for example, it may be used to form retaining walls, or other wall-types, made from other flowable materials. For this reason, the use of expressions such as "cementitious", "concrete", etc., as used herein should not be taken as to limit the scope of the method to these specific materials and includes all other kinds of materials, objects and/or purposes with which the method could be used and may be useful.

Moreover, when describing various optional configurations of the method, the expressions "retain", "prevent", "hold back", "limit", and any other equivalent expressions known in the art will be used interchangeably. Furthermore, the same applies for any other mutually equivalent expressions, such as "pouring", "filling", "transmitting", "conveying" and "inserting".

In addition, although the optional configurations illustrated in the accompanying drawings comprises various components and although the implementations of the method shown consist of certain geometrical configurations as explained and illustrated herein, not all of these components and geometries are essential and thus should not be taken in their restrictive sense, i.e. should not be taken as to limit the scope of the method. It is to be understood that other suitable components and cooperations thereinbetween, as well as other suitable geometrical configurations may be used for the method and corresponding retaining wall, as briefly explained and as can be easily inferred herefrom, without departing from the scope of the method.

Broadly described, the method of the present invention can facilitate the formation of a retaining wall and improve the stability of the earth adjacent to it before, during, and after excavation of the earth. Such stability renders the excavation more secure, and also reduces the charges on the retaining wall once it is formed. In densifying the earth around the retaining wall, as explained below, there may be obtained a reduction in the forces acting against the retaining wall.

Indeed, undensified earth has its own properties, which are different than densified earth, which means that the undensified earth can exert much larger forces on the wall and therefore reduce its ability to adequately resist horizontal displacement and rotational moments. Densification (i.e. by compaction) may impart the required resistances to the earth, and such densifed earth may therefore produce fewer stresses acting against the wall. Outside this densified zone, the earth maintains its original properties.

As shown in FIG. 1, the retaining wall 10 formed according to the method described below is a device which can be used for retaining or securing a volume of material such as earth 12 and/or liquid, for example, so as to provide a site 14 free of said material in which structures may be erected, work may be performed, etc.

According to one aspect of the invention, there is provided a method for forming a cementitious retaining wall. The use of the term "forming" when describing the method may refer to the creation, putting in place, hardening, etc. of a retaining wall. Furthermore, the term "cementitious" refers to such substances as concrete and other stiffening flowable materials. Alternatively, different non-flowable materials can be used for forming the retaining wall. These can include, but are not limited to, metal reinforcement, frames, plastic, wood, insulating, liquid-solid mixtures, epoxies, etc.

Figure 1A:
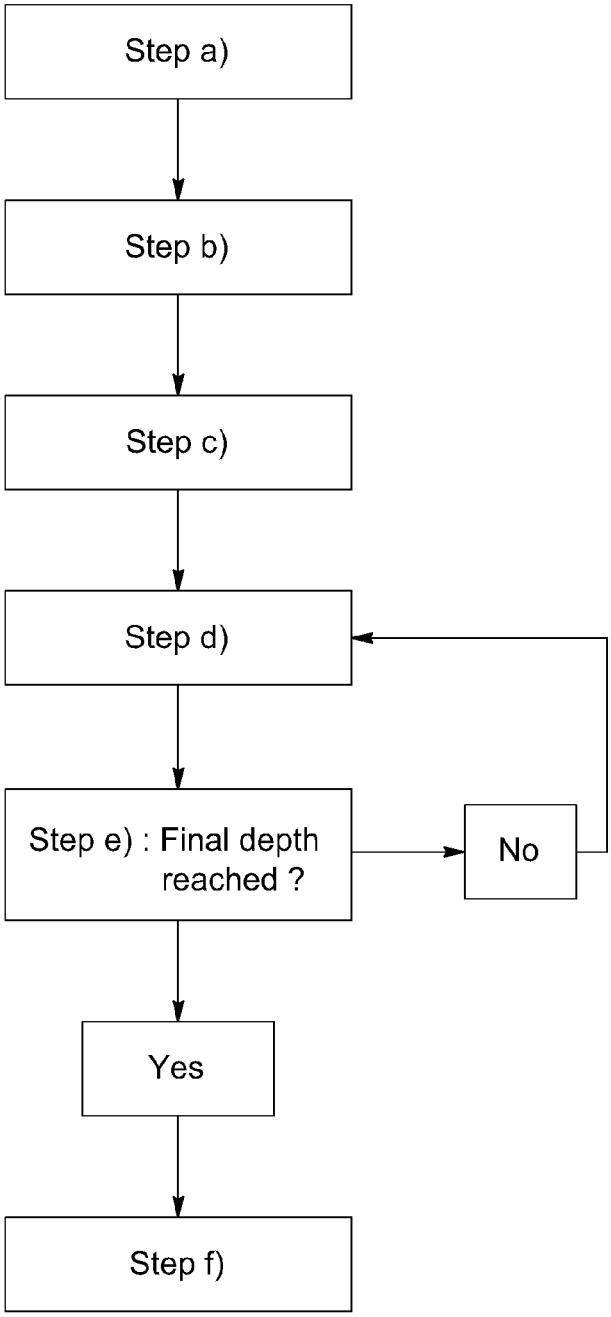
FIG. 1A is a flow chart of a method for forming a retaining wall, according to an optional configuration of the invention.
Figure 2:
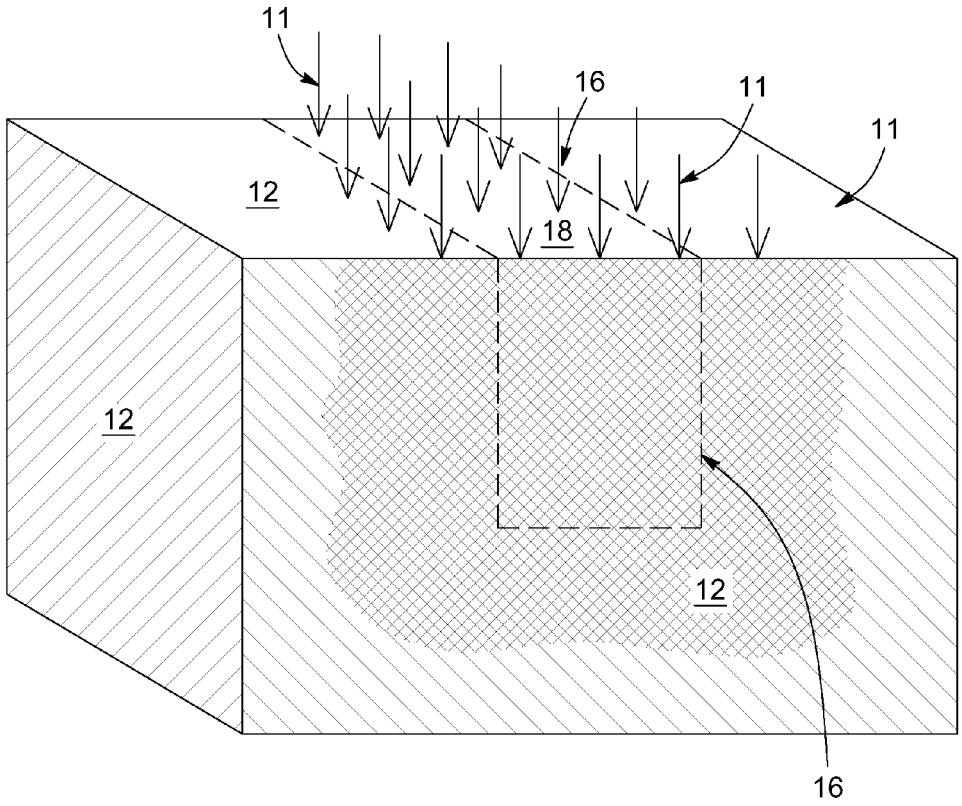
FIG. 2 is a schematic perspective view of an area of earth being compacted, according to an optional configuration of the invention.

The method includes step a), which relates to defining on an earth surface an outline of the wall to be formed and an example of which is shown in FIGS. 1A and 2. The use of the term "defining" in the context of describing step a) may refer to demarcating, delimiting, outlining, etc. the surface of the earth 12 so as to lay-out an outline 16 of the wall to be formed. Therefore, defining the outline 16 may include visually marking the earth 12, engraving the earth 12, or performing any other similar action so as to fix the boundaries of the wall to be formed. The outline 16 fixes the length and width of the wall to be formed, and thus it encompasses the area 18 of earth 12 that will be excavated in the steps described below. FIG. 2 provides an example of the outline 16 and area 18 in three dimensional relief. As can be seen, the outline 16 of the wall on the surface of the earth 12 is elongated because the wall will extend over some distance.

The method also includes step b), an example of which is shown in FIGS. 1A and 2, and which relates to compacting the area 18, thereby densifying the earth 12 underneath and adjacent to the area 18. This effect is exemplified by the crossed-lines within the earth 12 in FIG. 2. The term "compacting" can be understood to mean reduce in volume and/or increase in density. The goal of the compaction is to increase the density of the earth 12 of the area 18, a process which is known as "densification", and thus increase the earth's 12 stability. The compaction homogenizes and increases the density of the earth 12 of the area 18 where the wall will be built by applying highly localized and focused forces, which, because of the amount of energy transmitted to the earth 12 by the compaction, breaks any cavities and/or other obstructions in the earth 12 and creates passive pressures that build up in the compacted earths 12, which can increase the shear strength and stability of the earth 12. In cases of unsaturated fine earths 12, the densification increases the suction potential of the earth 12 and further increases its stability when excavation is performed. The highly focused energy can also beneficially force moisture out of the earth 12, which further increases density and earth stability. Thus, columns of stable earth 12 can be created by the compaction process directly below the compacted area 18, often to a depth as deep as about 10 ft. for each excavation stage. This process is known as "deep earth compaction". It is thus understood that this stability is not limited to the earth 12 directly under the area 18, but can extend laterally to earth 12 in adjacent areas. Thus, it can now be appreciated that compaction stabilizes the earth 12 below and adjacent to the area 18 being compacted, which provides stability to the area 18 during excavation.

In one possible application of compacting the area 18, a suitable mechanism is used to compact both the area 18, and the surface of the earth 12 adjacent thereto. The extent of earth 12 compacted adjacent to the area 18 can vary, and will depend on many factors such as, but not limited to, the amount of stability required in the adjacent portion, the properties of the earth 12 being compacted, the nature of the retaining wall eventually formed, etc. In compacting these adjacent areas, many columns of suitably densified soil can be created underneath the places compacted. These columns may advantageously reduce the forces acting against the retaining wall which is eventually formed because the high density earth 12 within these columns may not be subjected to the usual stresses and movements of non-densified earth.

In one optional configuration, and as exemplified in FIG. 2, the compaction is performed by applying a vibrational force 11. Such a vibrational force 11 may be a force that is applied at repeated intervals at very high frequencies. The effect of the application of such a force 11 is to continuously and repeatedly hammer the earth 12 being compacted, thereby densifying the earth 12 beneath the compaction point and adjacent to it. The vibrational force 11 can be applied at an acceleration value between about 0.5 g to about 5 g, depending on many factors varying from the extent of densification required to noise restrictions at the compaction site, among other factors.

Figure 6:
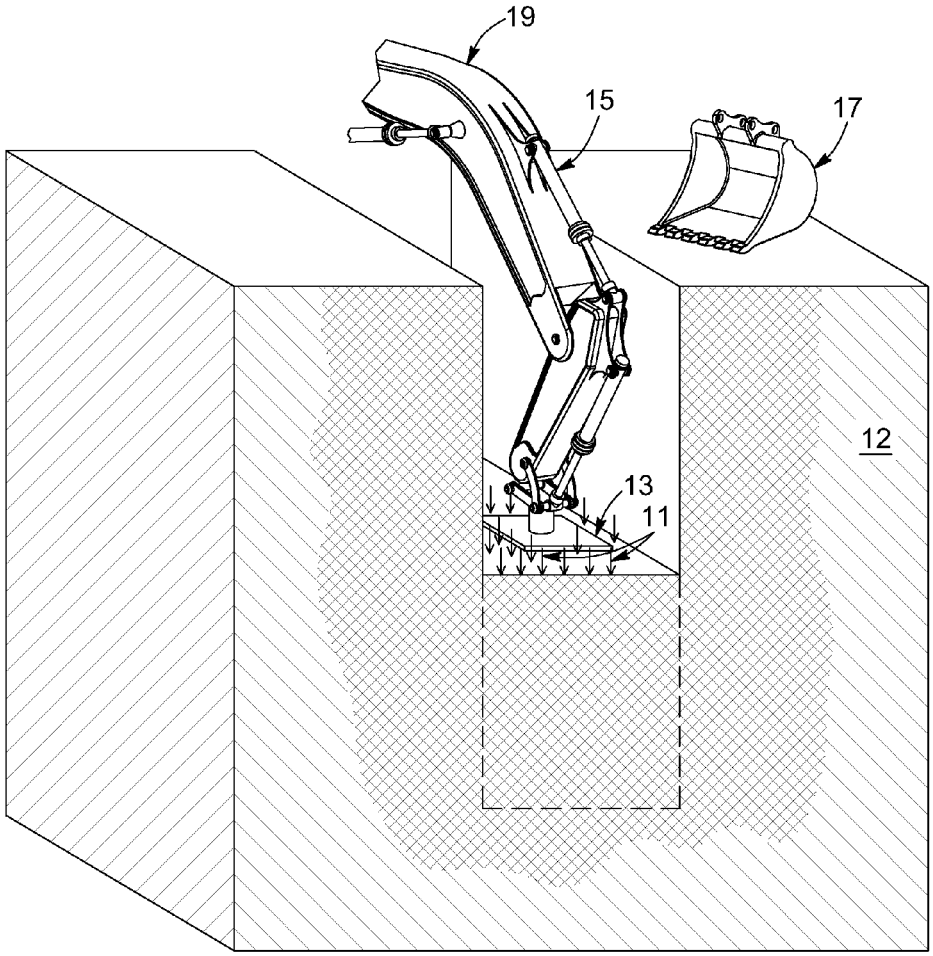
FIG. 6 is a schematic perspective view of a vibratory plate compacting a bottom surface of a wall cavity, according to an optional configuration of the invention.

The compaction can be performed using any suitable tool, such as a vibratory plate 13, an example of which is provided in FIG. 6. Such a vibratory plate 13 can be hydraulically or pneumatically driven, depending on the equipment and power supplies available on site, among other factors. Is some possible configurations, the vibratory plate 13 is connected to, and powered by, a hydraulic circuit 15, which can originate from equipment on site or be an independent circuit 15 specific to the vibratory plate 13. Such a circuit 15 advantageously may provide the requisite power and durability required to apply the vibrational force 11, both on the surface, and at depth. Where the circuit 15 originates from device 19 on site, the vibratory plate 13 can be connected to such device 19. In one such optional configuration, the vibratory plate 13 can be used with the device 19 powering a digging tool 17 used for excavating, for example. The vibratory plate 13 can thus be interchanged with the digging tool 17 once the excavation operations have ceased. One example of how such interoperability might work includes the following: the vibratory plate 13 is mounted to the device 19 so as to compact the earth 12 and once compaction operations are finished, the vibratory plate 13 is replaced with the digging tool 17 so as to excavate the earth 12 that was just compacted. This interchanging of digging tool 17 with the vibratory plate 13 may advantageously allow for the use of very strong vibrational forces 11, which may suitable densify soil at depths as deep as 7 m or more.

In another optional configuration, the compaction can be performed with a compaction device 19, which can form part of a larger system. The compaction device 19 can compact the earth 12 of an area 18 where the retaining wall will be created. The device 19 may include a vibratory steel plate 13, measuring about 2.5 ft×2 ft, although plates 13 of different sizes can also be used. The vibratory plate 13 can be functionally attached to the arm of a hydraulic shovel, for example, which is generally readily available on construction sites. In this configuration, the vibratory plate 13 can be lowered by the shovel's arm to compact at various depths. In another optional configuration, the vibratory plate 13 can also be functionally attached to a crane and/or other similar device, and lowered accordingly into the excavated depths, as explained below, in order to bring the compaction energy and process in the space provided by a trenching box and by the excavation below it, which may improve the earth's 12 properties at depths in multiple directions while building the wall. This technique of compacting at depths allows for workers on site to readily intervene if necessary, such as if obstacles are found in close proximity to the compacted and/or excavated area, for example.

During a typical operation, the compaction device 19 can be positioned over an area of earth 12 to be compacted, which is roughly aligned along an axis of the wall to be built. The device 19 is then activated, and the vibratory plate 13 can methodically and forcefully pound, hammer, compact, etc. the area. After determining whether the earth 12 of the area is sufficiently compacted, the compaction device 19 is moved to another area, and the operation is repeated. This continues for the entire area. The term "area" in the present context refers to a delimited space on the surface which roughly conforms to the width and length of the outline of the retaining wall to be created. This area includes earth 12, which is compacted by the compacting device 19. The influence of this particular compaction method is three dimensional and therefore the sides of the wall outline are thus also being compacted.

Compaction can continue until the desired earth properties are obtained 12. One such property is the percent compaction of maximum density. The percent compaction compares the measured density achieved on site after compaction with the laboratory value for similar earth measured in the laboratory. In some configurations, compaction may yield percent compaction values between about 90% and about 100%, when compared to the reference Proctor density value for the given earth being compared.

Figure 3:
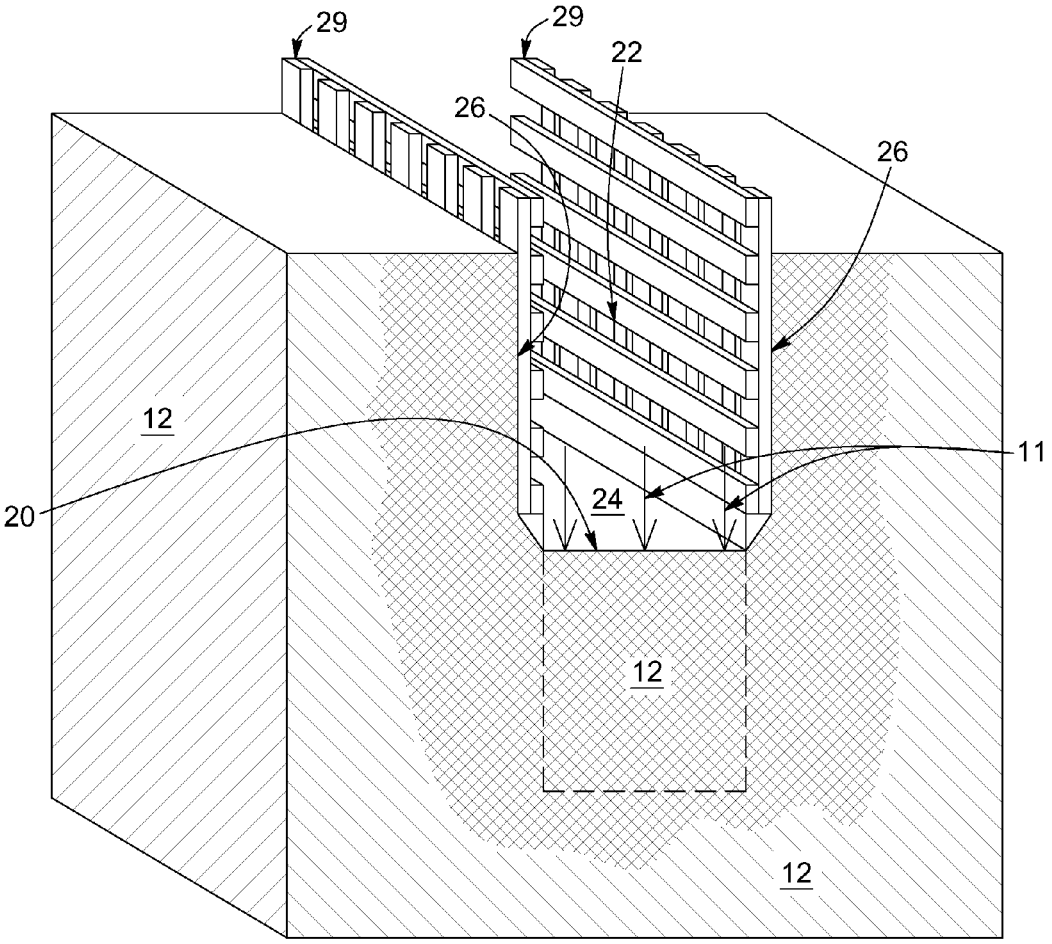
FIG. 3 is a schematic perspective view of a wall cavity having been formed by excavating the compacted area of earth of FIG. 2, FIG. 3 also showing a bottom surface of the wall cavity being subjected to another compaction.

The method also includes step c), an example of which is shown in FIGS. 1A and 3, and which relates to excavating the earth 12 from the area compacted in step b) to an initial depth 20 so as to create a wall cavity 22. The wall cavity 22 has a bottom surface 24 and side surfaces 26.

Figure 7:
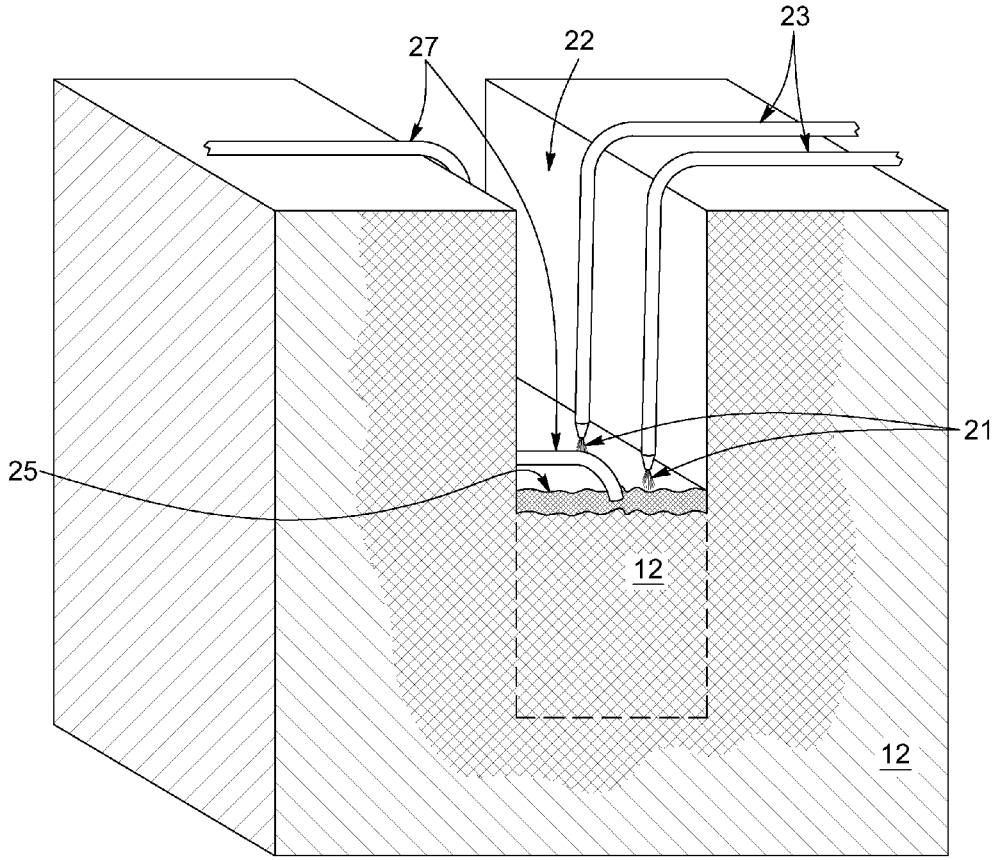
FIG. 7 is a schematic perspective view of hydraulic jets being applied to a bottom surface of a wall cavity so as to excavate the wall cavity, according to an optional configuration of the invention.

The excavation of the earth 12 can be completed using any suitable device. One example of such a device, the digging tool 17, is provided in FIG. 6. Indeed, such a device can be used as part of the larger system mentioned above. This excavation device can be used for excavating the earth 12 of the area that has been compacted as described with respect to step b). The excavation device can be any known shovel, digger, scoop, trowel, dredge, etc. which is operated mechanically, pneumatically, and/or hydraulically. In one possible configuration, and as exemplified in FIG. 7, excavation can be performed by hydraulic fluid jets 21, such as jets of water, supplied by hoses 23. The hydraulic jets 21 can be applied under pressure to the earth 12 of the area to be excavated, thus liquefying the earth to be excavated and creating a type of slurry 25. This slurry 25 can then be vacuumed and/or removed from the wall cavity 22 using a negative-pressured hose 27, for example. This technique may allow for successive layers of earth 12 to be excavated, and can be very practical whenever the workspace on site is limited and does not allow for the use of a mechanical or hydraulic digging tool. It is equally practicable when there are multiple buried obstacles in the earth 12 to be excavated that are difficult to identify, or have been poorly identified. Furthermore, excavation using this technique may allow for the creation of tunnels below existing underground structures without requiring their demolition.

Returning to FIG. 3, after the earth 12 of the area has been compacted in step b), the earth 12 can be removed and the risk of the adjacent side surfaces 26 caving into the wall cavity 22 can be greatly reduced. The excavation is performed to the initial depth 20, which can vary from between about 2 m and about 3 m, for example. The initial depth 20 corresponds to the bottom of the first excavation stage. As multiple excavations are performed, as described below, the initial depth 20 will be replaced by other, n-number intermediate depths, which correspond to the number of excavation stages performed. The excavation performed creates the wall cavity 22, which can be any pit, crater, hole, depression, etc. formed by the excavation. As multiple cycles of compaction/excavation are performed, the wall cavity 22 will change in shape, and more particularly, will be deeper. After each excavation, however, the wall cavity 22 will have a bottom surface 24 which corresponds to the bottom of the wall cavity 22 at that exaction stage, and which may be substantially planar or more irregularly shaped. The wall cavity 22 is bound on its side with side surfaces 26, which will also descend with each excavation stage, and which may be highly stable because of the compaction performed on the earth 12 adjacent to area described above. The side surfaces 26 can consist of compacted earth 12 that has been exposed by the excavation. In some instances, a membrane, such as a plastic sheet or a wood surface, may be affixed to the side surfaces 26.

In some optional configurations, and in order to potentially optimize the overall wall costs and efficiency, it may be desirable to reinforce or support the side surfaces 26 with a retention structure 29. The retention structure 29 can take many forms. One such form can consist of steel plates and/or steel boxes known as "caissons" or sheet pile boxes, which can be installed temporarily. These steel plates and/or caissons can vary in depth from about 1 m to about 3 m. These retention structures 29 are often installed only during the first excavation stage so as to stabilize said stage. In one example of the installation of such retention structures 29, the excavation is performed to a depth of about 1 m, then the caisson is pushed into the ground, and then the next round of compaction/excavation begins. Caissons are essential large steel boxes which are reinforced to hold back a volume of material and large earth and surcharge pressures, if required. In another example of the installation of the retention structures 29, the excavation can proceed and simultaneously, the caisson can be installed while excavation continues.

The method also includes step d), an example of which is also shown in FIGS. 1A and 3, and which relates to compacting the bottom surface 24 of the wall cavity 22 and then excavating the earth 12 from the compacted bottom surface 24. The compaction of the bottom surface 24 can be performed as described above with respect to step b). Since the compaction will occur at the initial depth 20, a suitable compaction device can be used to complete the work. One example of such a device includes the digging tool described above, where a vibratory plate can be interchanged with the digging tool to compact at depth. The effect of compacting the bottom surface 24 may be similar to the effect of compacting the area described above. More particularly, the application of compaction force, such as a vibrational force 11, for example, densifies the earth 12 underneath the compacted bottom surface 24, and adjacent to it. This effect is exemplified in FIG. 3, where the densified earth 12 is shown as tightly-spaced crossed-lines. Such densification may stabilize the earth 12 underneath and adjacent to the wall cavity 22, thereby facilitating the excavation and potentially reducing loads against the retaining wall formed therein.

Once the bottom surface 24 is sufficiently compacted, the earth 12 thus compacted is subsequently excavated so as to deepen the wall cavity 22, thus continuing the excavation. The use of the term "subsequently" in the context of step d) may refer to the sequential nature of the compaction and excavation steps. For example, the compaction operation is performed before the excavation operation, and this sequence can be repeated in the same order, until there is no longer a need for further compaction and excavation, as explained below. The number of iterations of this sequence is not limited, and can be determined based on a variety of factors, some of which include the properties of the earth 12 being compacted/excavated, the final depth of the excavation, site operation restrictions, etc.

Figure 4:
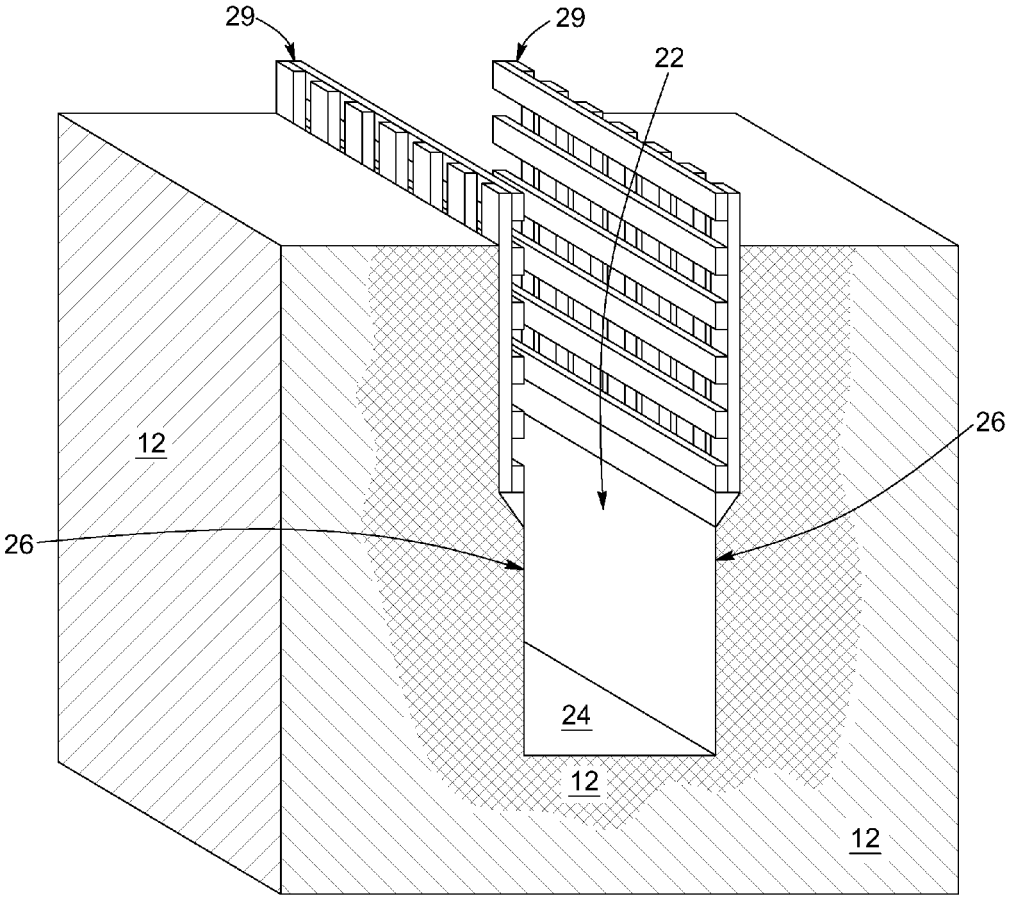
FIG. 4 is a schematic perspective view of the wall cavity of FIG. 3 after excavation of the compacted bottom surface.

The method also includes step e), an example of which is also shown in FIGS. 1A, 3 and 4, and which relates to repeating the compaction/excavation of step d) until a final depth of the wall cavity 22 is reached. Once the first excavation stage is excavated, a suitable compaction device can begin compacting the bottom surface 24 thereby created, as described above with respect to FIG. 3. Once this bottom surface 24 is compacted, the excavation can continue to another excavation stage, each of these subsequent excavation stages having its own bottom surface 24. Optionally, retention structures 29, such as steel plates, can be placed and secured against the side surfaces 26 so as to temporarily retain the earth 12 if necessary, and they can follow the excavation device as it excavates deeper and deeper. The excavation device can also cut into the side surfaces 26, such as below the steel caissons, for example, to facilitate the descent of the retention structures 29 without having to bang them into the ground, thus reducing noise.

Thus, it is apparent how this technique of compaction/excavation can be repeated until the desired excavation depth, or final depth, is achieved. One example of the location of the final depth 28 is provided in FIG. 5. The final depth 28 can be of any value, and depends largely on site requirements and restrictions. One example of a range of final depths 28 can be from about 4 m to about 12 m. In some optional configurations, the final depth 28 is greater than the depth of the adjacent excavated work site so as to confer some passive resistance to the retaining wall eventually formed. In some cases, only a small penetration below the depth of the excavation is required. It is apparent that different variants of the compaction/excavation cycle are possible. For example, a deep and prolonged compaction can be first performed, and then be followed by a first excavation, and then a second excavation, with no compaction in between, because the earth 12 was sufficiently compacted at depth during the only compaction operation. It is therefore understood that it is not necessary that each compaction operation must be followed immediately by an excavation operation, nor that each excavation operation must be immediately preceded by a compaction cycle.

Figure 5:
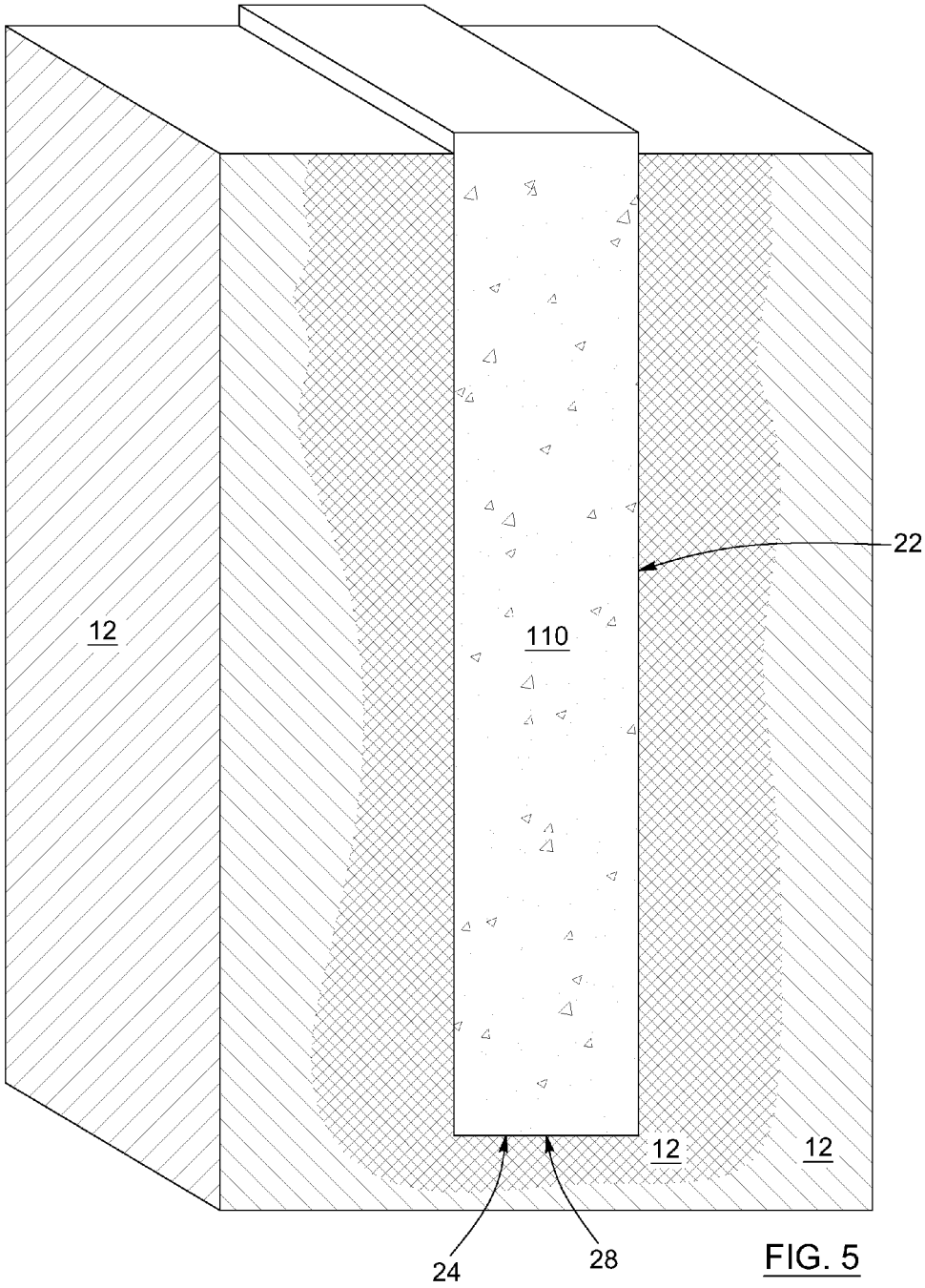
FIG. 5 is a schematic perspective view of a wall cavity filled with a cementitious material, according to an optional configuration of the invention.

The method also includes step f), an example of which is also shown in FIGS. 1A and 5, and which relates to filling at least part of the wall cavity 22 with a cementitious material 110 so as to form the retaining wall. Once the earth 12 has been excavated to the final depth 28, the retaining wall is ready to be formed. The term "filling" as used in the context of step f) can refer to any operation whereby the cementitious material 110 is added to the wall cavity 22. Although FIG. 5 provides an example of a wall cavity 22 completely filled with the cementitious material 110, the wall cavity 22 can also be filled only partially. For example, a partial filling of the wall cavity 22 may be required if another structure will be mounted onto the retaining wall formed, as explained below. The "cementitious material" 110 referred to in step f) can be any flowable material that stiffens over time. Alternatively, the retaining wall can be formed from traditionally non-flowable material, such as stones, gravel, wood, frames, metals, etc.

One example of the filling of step f) is now described. A filling device, which can be part of the system described above, can be used for filling the wall cavity 22 with a pour of cementitious material 110 so as to form the cementitious retaining wall. The filling device can be any known backfiller that allows for a pour of fresh concrete, cement, etc. to be added to the wall cavity 22. For relatively deep final depths 28 (i.e. about 8 m), the pour of such a volume of heavy cementitious material 110 may perform an additional and function of compacting the bottom surface 24 at the final depth 28 of the excavated area upon its fall impact. The type of cementitious material 110 used can be concrete with a resistance in the range of about 0.5 MPa to about 60 MPa. The resistance can vary depending on the purpose for which the retaining wall will be used. For example, if the retaining wall will be used to support only charges generated by the retained earth 12, the resistance can be in the range of about 0.2 MPa to about 15 MPa. If the retaining wall will be situated adjacent to a transport conduit, for example, the resistance can be in the range of about 15 MPa to about 30 MPa. Such a restraining wall may be located near train tracks, and may be used to stabilize the rail embankment upon which the train will pass.

In yet another example, if the retaining wall will be used as a temporary or permanent foundation for a structure or for heavy equipment, the resistance can be in the range of about 20 MPa to about 50 MPa. The thickness of the retaining wall created by the pour, as well as the strength of the concrete required, can vary depending on a plurality of factors such as the volume of earth 12 and surcharges to be retained, the earth 12 conditions on site, the purpose the wall will serve, etc.

The use of a cementitious retaining wall is advantageous where the retaining wall, in addition to retaining an adjacent volume of material, must also act as an impervious barrier. This can be the case, for example, when there is an underground water course, wet earths, slurry wastes, liquids, or contaminated earth, or the wall is adjacent to a landfill or serves as a dam. Such a wall may offer stabilization to shifting waste slurry, for confining dykes and/or for securing landslides areas. Sheet pile walls are generally not sufficiently impervious because of the joints at which they are joined. However, the thick cementitious retaining wall can be impervious, and chemical additives can be added such as polymeric additives, for example, to the cementitious mix to increase such imperviousness characteristics. Furthermore, the imperviousness of the wall can be increased with a liner or geomembrane, which can be installed before or after the pour.

The thickness of the cementitious retaining wall can also advantageously serve as a thermal insulator, which insulates the retained earth 12 from the cold which may be transmitted from the adjacent site. Indeed, one example of a range of thickness values, which correspond to the outline of the wall, can be in the range of about 1 m to about 6 m. Such thickness may advantageously prevent freezing of the retained earth 12 and the corresponding unpredictable stresses generated thereby over the entire depth of the wall. This is in direct contrast to sheet pile retaining walls, which being composed of metal sheet piles, act as thermal conductors and transmit the cold from the site into the retained earth. With the retaining wall being formed, the earth 12 on the required side of the wall can be excavated.

It can now thus be appreciated that the above-described method and system for forming a retaining wall can be used to create a plurality of different types of retaining walls, some of which are hereinbelow described and exemplified in the accompanying figures. These walls can be referred to as "massifs" and/or "masses", and can be employed with the name of their inventors so as to be designated as a "Garzon massifs" and/or a "Garzon heavy masses", for example.

Figure 8:
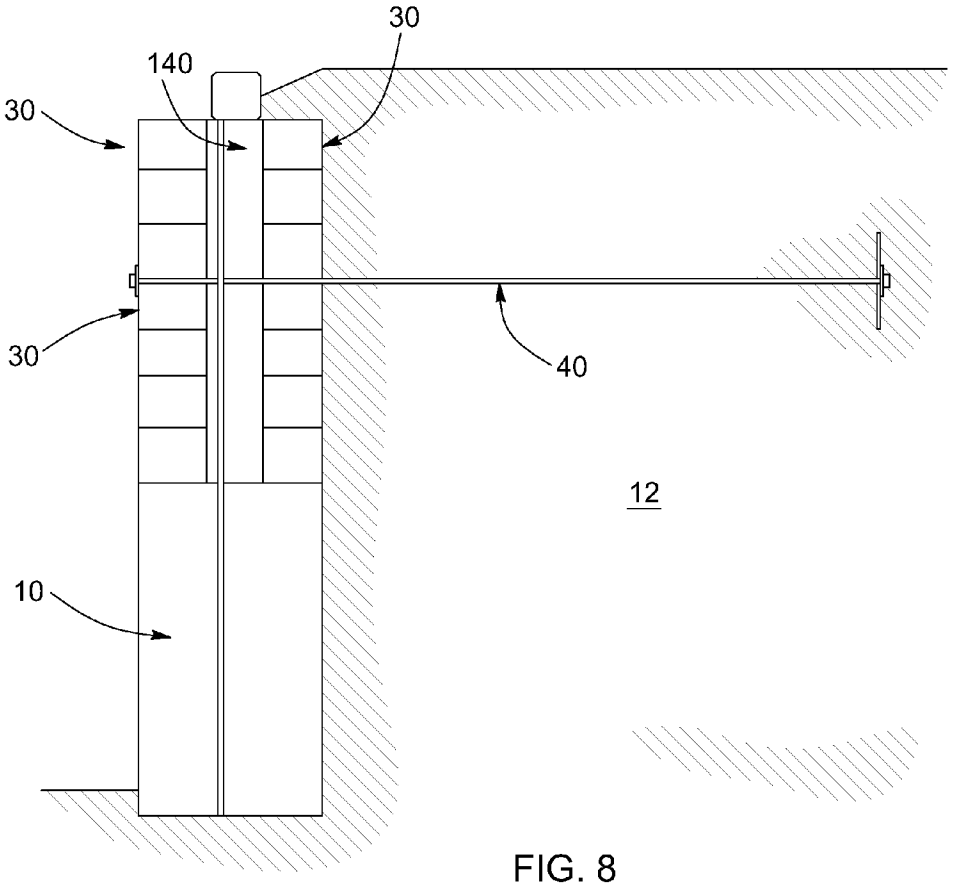
FIGS. 8 to 14 are schematic elevational views of various optional configurations of retaining walls.

FIG. 8 provides an example of a retaining wall 10 (or simply "wall 10") topped by a sandwich consisting of a poured in place wall 140 between a column of concrete blocks 30. Alternatively, the column of blocks 30 can be piled vertically, and then the wall 140 can be formed from a pour of concrete. This configuration of the sandwich retaining wall 10 can be used where there is no earth 12 on one side or both sides to contain the fresh concrete pour, or to support a possible reinforcement 40, such as a tie-back. The blocks 30 in this configuration can serve to support the anchor 40, and the blocks 30 are piled vertical until the level of the anchor 40 is reached. The anchor 40 can be any device which supports the wall 10 such as a reinforcement bar, rebar, steel or plastic cables, etc.

Figure 9:
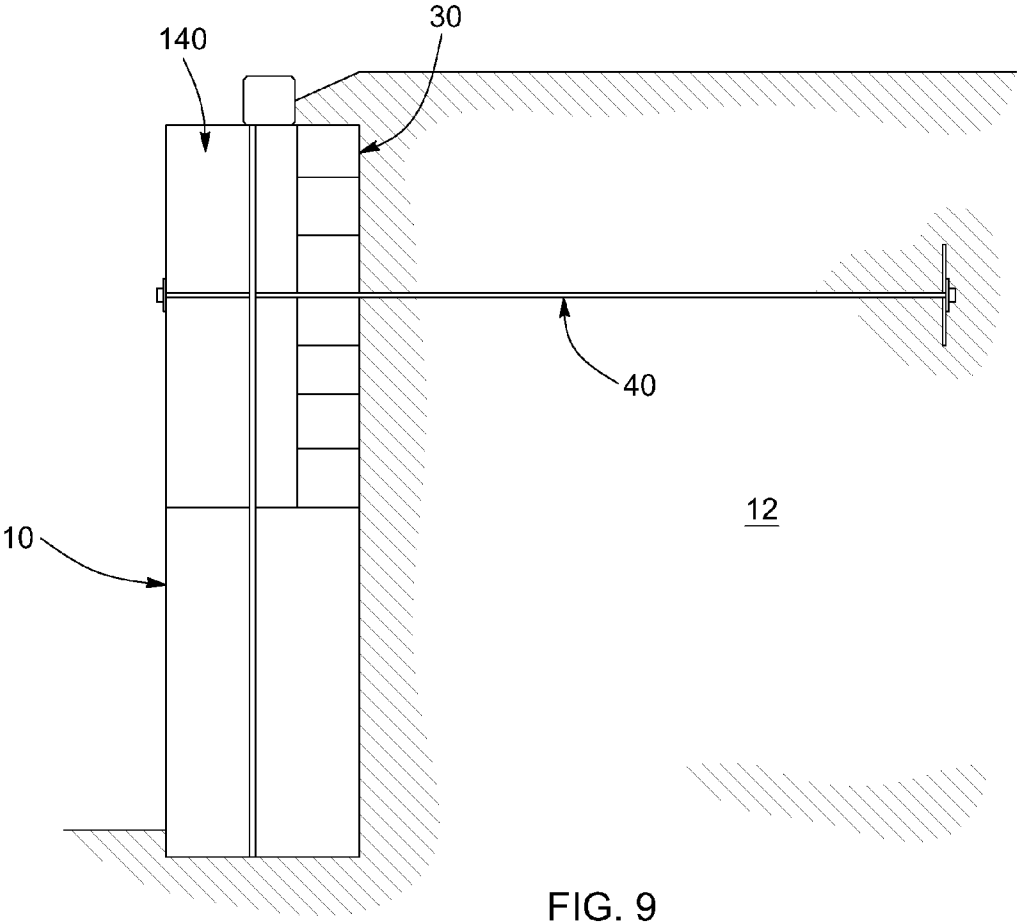

FIG. 9 provides another example, which includes a retaining wall 10 in cases where there are abutments of land which are relatively high. In a typical operation, a shoring box or steel caisson of about 2.4 m deep can be quickly installed by pushing it into the earth 12 so as to temporarily shore up the wall of earth 12 once excavation of the shoring box begins. This is particularly useful if the wall 10 is adjacent to a railway or road embankment, for example. As with the retaining wall 10 exemplified in FIG. 1, this allows an anchor 40 to be laid at a level of the blocks 30 so as to reinforce the wall 10. The pour can then be added to the excavated area of the shoring box so as to create a different precast wall 140.

Figure 10:
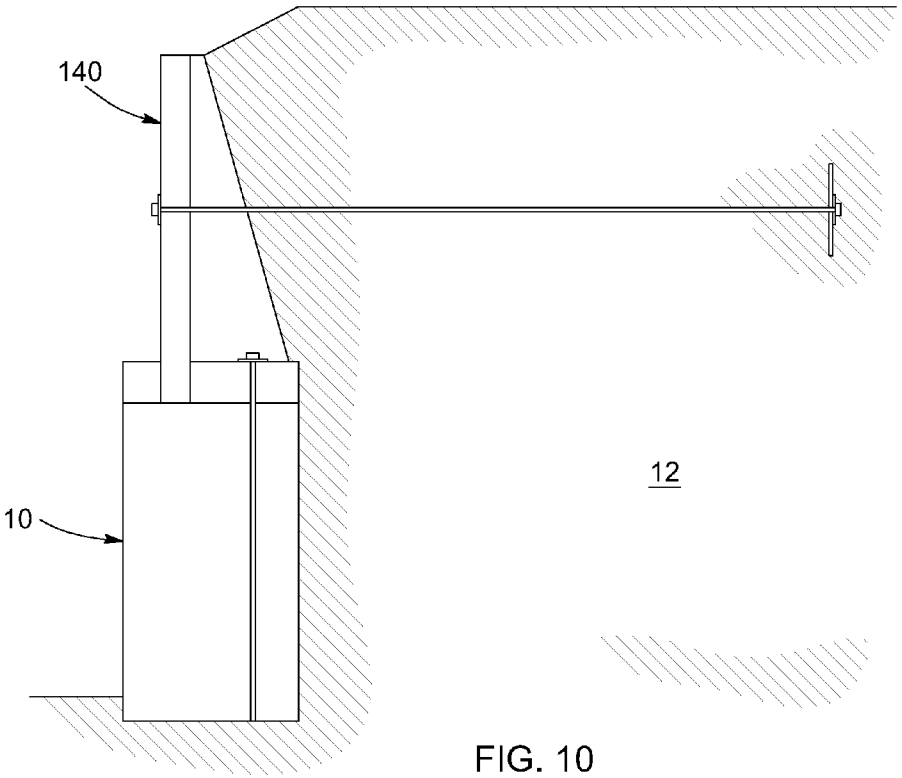

FIG. 10 provides yet another example, where the wall 10 is capable of being used as an anchoring wall for a precast wall 140 placed on top. This configuration is ideal where a precast wall 140 is desired, but the earth 12 characteristics are not conducive to supporting the precast wall 140. The retaining wall 10 can thus serve as a foundation for the precast wall 140. Optionally, the precast wall 140 can be reinforced with tie-backs 40, anchors, reinforced earth (such as geomembranes, plastic sheets which create a mesh giving strength to the earth, etc.). In this configuration, the retaining wall 10 may be known as an "anchoring mass".

Figure 11:
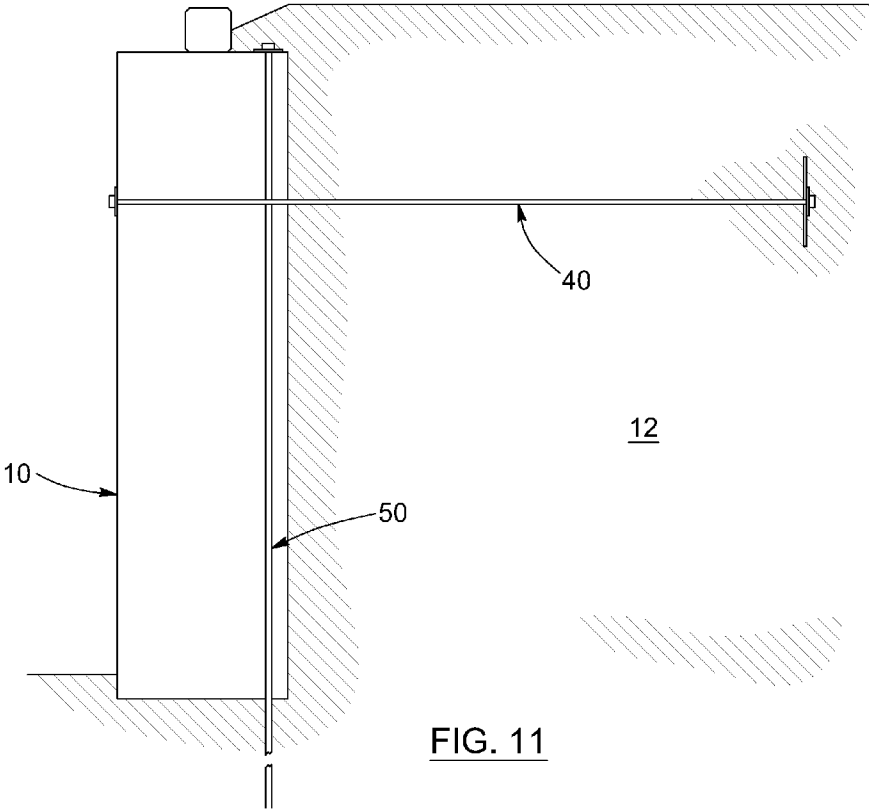
Figure 12:
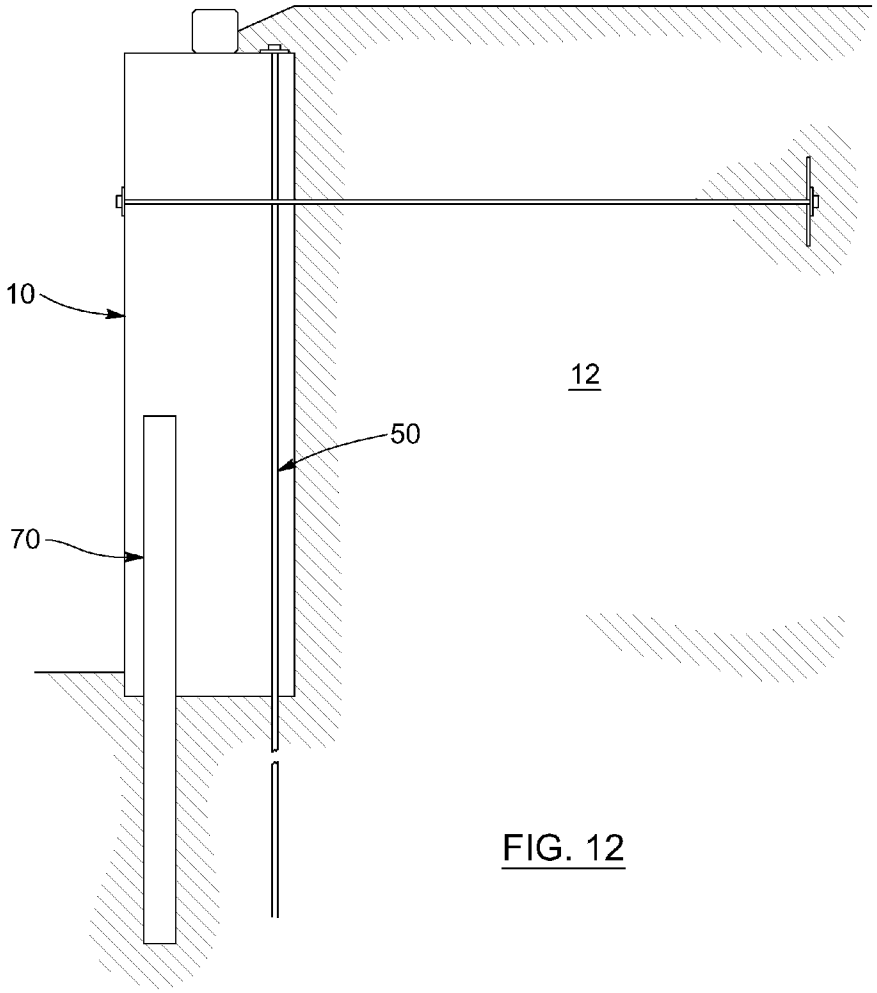

FIGS. 11 and 12 provide other examples, where the wall 10 being used with a vertical anchor 50 and/or a vertical pile 70, such as a bearing pile for example. Vertical anchors 50 counterbalance the moments induced by the mass of earth 12 being retained so as to provide moment stability to the wall 10. Vertical anchors 50 are often used to meet required safety factors. Other forms of compensation can be used as well. For example, vertical piles 70 add stability to the earth 12 near the toe of the wall 10 so as to compensate for liquefaction forces that can be generated by the stress induced about the toe of the wall 10 by rotational moments caused by the mass of retained earth 12. Optionally, the vertical pile 70 consists of stones inserted below the final depth, the stones being easily inserted into the soft earth and through the unhardened concrete pour. Another example of compensation includes tie-back anchors 40, such as metal cylinders or H-bars, which can be attached horizontally to the wall 10 and anchored further away to a deadman. The vertical anchor 50 can be added to the excavated area before or after the concrete pour. Vertical anchors 50 can also provide additional stability to thinner walls 10, as but another example, thus providing shearing and moment resistance to the wall 10. In the case of a retaining wall 10 resting on a soft sensitive clay, the provision of imbedded piles 70 inside the fresh concrete pour can enable a reduction of the stressing on the clay at and near the toe of the wall and prevent the clay plastification and liquefaction and the onset of an undesirable retrogressive earth failure.

Figure 13:
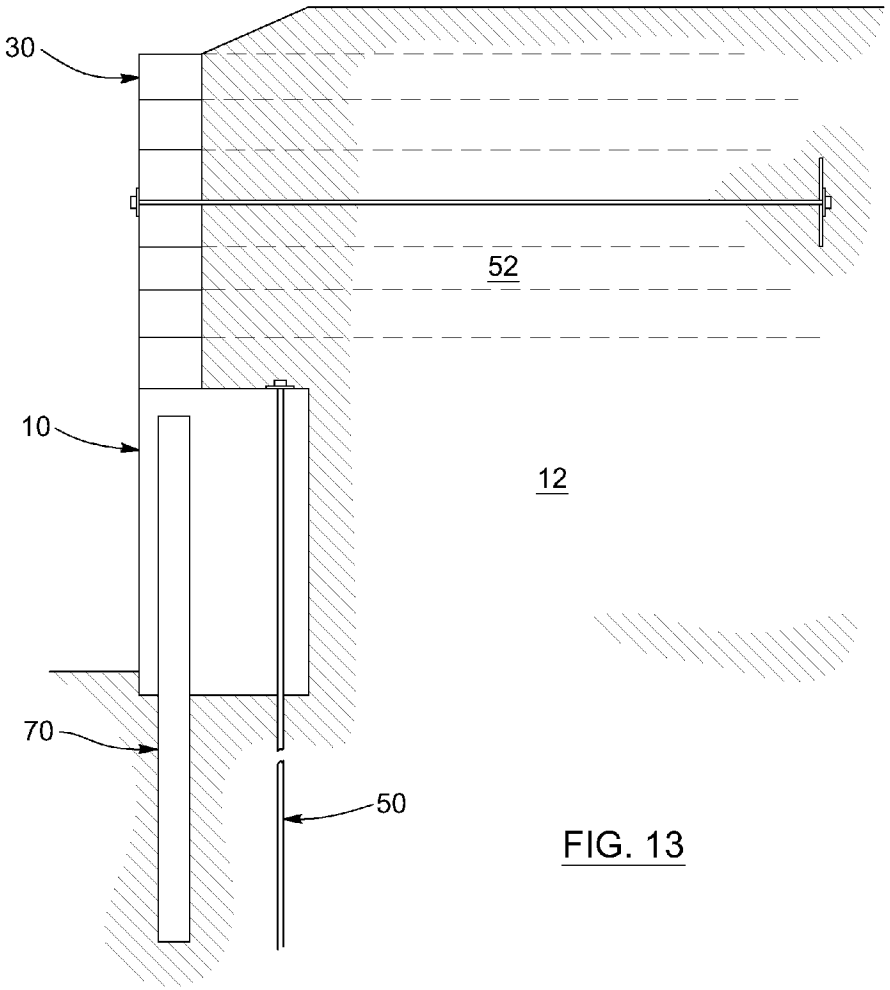

FIG. 13 provides yet another example of a wall 10, this wall 10 used in combination with blocks 30, vertical anchoring 50 and/or reinforced earth 52. Reinforced earth 52 can be any frictional backfill with embedded shear and tension reinforcement, which may be compacted, and which adds stability to the earth 20 so that it is self-sustainable. The reinforced earth 52 can consist of strips of metal, a mesh, a cloth comprising various sheets of geotextiles and/or any other similar material or device which provides stability to the earth 12.

Figure 14:
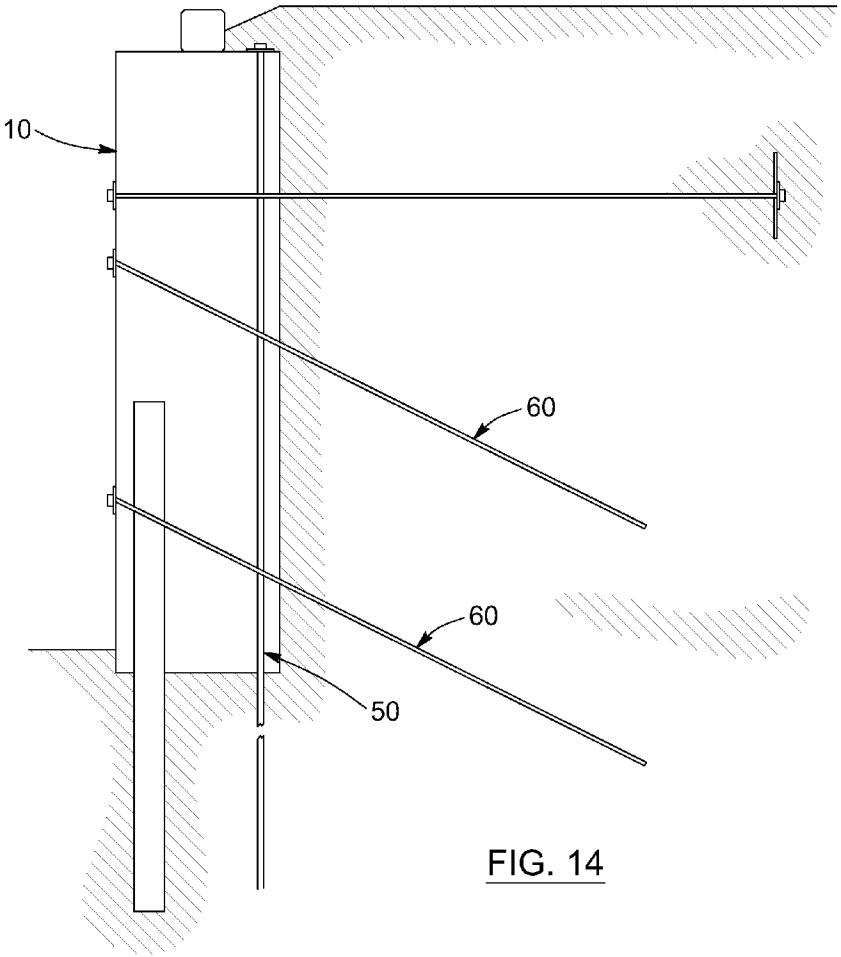

FIG. 14 provides yet another example of a wall 10, where a vertical anchor 50 is used in conjunction with inclined grouted anchors 60 and/or micropiles to provide additional stability to the wall 10. Inclined grouted anchors 60 can be installed at any suitable angle in a rock or till or dense earth layer. The grouted vertical anchor 50 provides additional anchoring to the grouted anchor 60, and is ideal in cases where there is insufficient space to install a deadman or inclined anchors.

Figure 15:
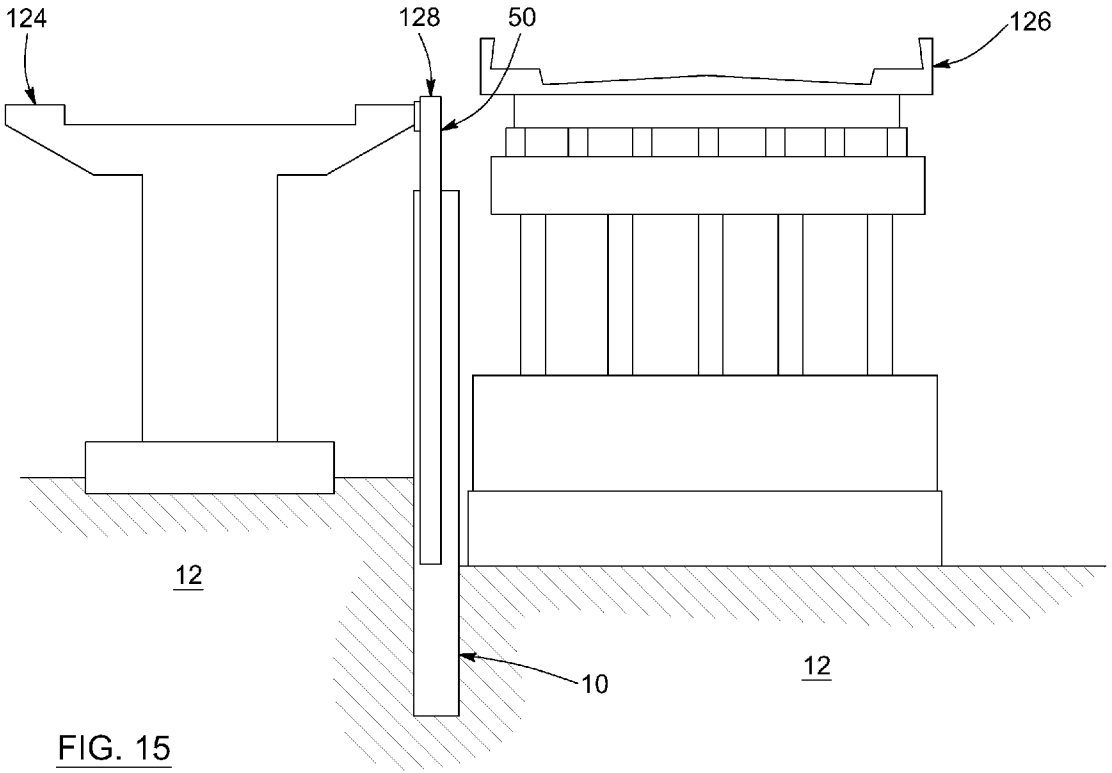
FIG. 15 is a schematic elevational view of a retaining wall being used between two structures, where a poured in place retaining wall penetrates the ground below the excavation level and is anchored to one of the structures at the upper level by means of an embedded column in the poured wall, according to an optional configuration of the invention.

FIG. 15 provides yet another example of a wall 10, where the wall 10 is installed between an existing structure 124, such as a bridge, and a new structure 126 to be built. In this optional configuration, the wall 10 and/or vertical anchor 50 can be anchored to the existing structure 124. Also optionally, the wall 10 can be embedded in the earth 12 below the excavation level of the site in order to mobilize the passive earth resistance to support the wall toe. This configuration of the wall 10 may be suitable where there is limited space between the two structures 124,126, and only a limited width is available for the construction of the wall 10. Optionally, the vertical anchor 50 is introduced in the fresh concrete pour so as to enable anchoring of the wall 10 above the existing structure.

Advantageously, such a wall 10 can provide a working width at the top of the wall 10, such as a top foundation surface 128, enabling the movement of goods by vehicles along a pathway, of small equipment such as drilling and grouting equipments, pumping activities, instrumentation and monitoring installations, etc. The foundation surface 128 can have a width of about 1 m to about 6 m. The foundation surface 128 can also provide a platform for the installation and anchoring of a new jersey and/or other protection structures, as well as fences on the top of the wall. In cases where the excavation is to be performed on one side of the wall 10 and then on the other side, such as the case for repair of bridges, for example, where there is a need to maintain the traffic on one side while the other side is demolished and repaired, the single wall 10 serves both situations and accepts the reversal of forces on it.

Figure 16:
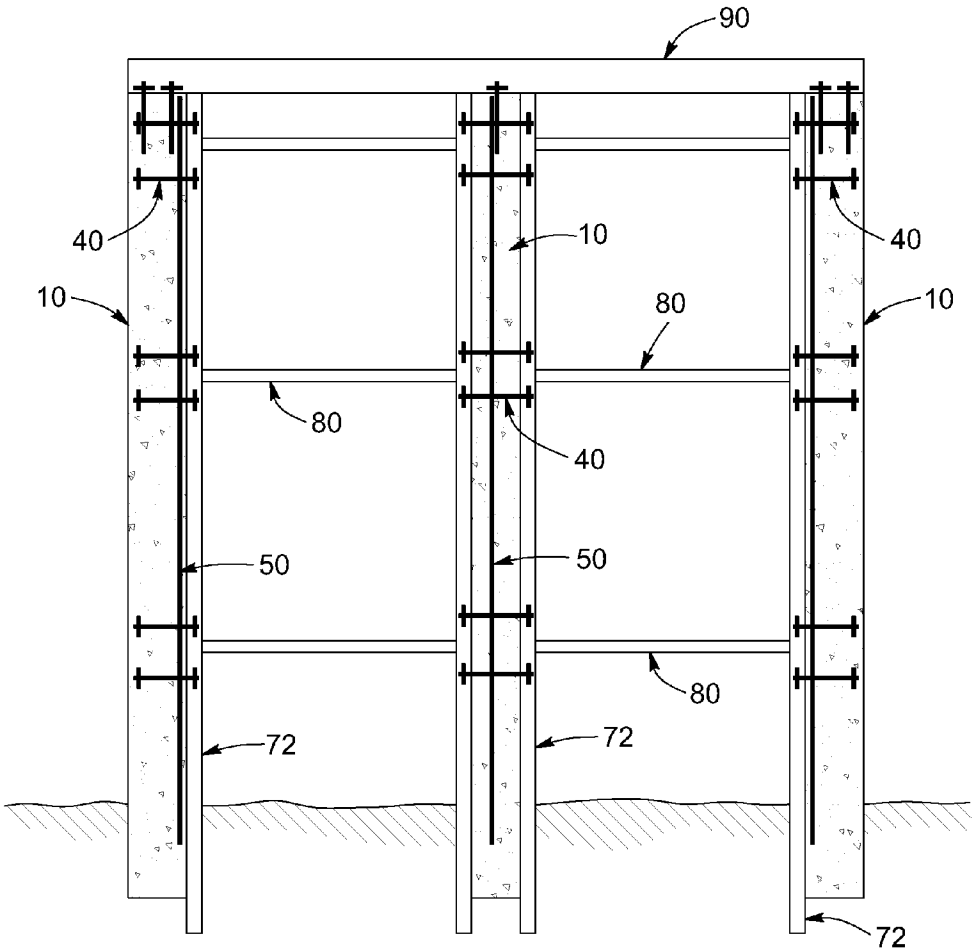
FIG. 16 is a schematic elevational view of multiple retaining walls being structurally connected by steel beams and having foundation beams mounted on top of the retaining walls, the retaining walls also serving as foundation walls, according to an optional configuration of the invention.

FIG. 16 provides yet another example of retaining walls 10, where multiple retaining walls 10 are installed to provide a very solid foundation. This configuration of retaining walls 10 can be advantageous for earths that tend to naturally liquefy, or to enable hydraulically controlled floating structures on soft earths. This configuration may also be advantageous where more support and/or reinforcement is desired of the foundation, such as in areas where there is a risk of earth liquefaction resulting from an earthquake, for example. Further advantageously, the use of multiple walls 10 can reduce the need for one very large and heavy wall 10, thus allowing for the use of less concrete and providing lower localized loads. Although FIG. 16 shows the use of three retaining walls 10, it is understood that the use of more or fewer walls 10 is also possible.

Each of the areas defined by the retaining walls 10 can be compacted, excavated, and filled as described above. The excavation of the area between the walls 10 may be performed to a depth that is less than the depth of the walls 10, thereby allowing the walls 10 to provide moment and other support against rotational and shear forces. Once the walls 10 are freshly poured, vertical columns 72 can be inserted to provide stability to the toe of the walls 10, thereby augmenting the shear resistance capacity against earth forces. Optionally, the vertical columns 72 are driven below the depth of the corresponding wall 10. The columns 72 can be secured into the solid wall 10 with anchors 40, which are inserted into the fresh pour. Optionally, the columns 72 are inserted into the fresh pour, and include polystyrene foam coverings on at least some of the portion of the column 72 facing the excavation. These foam coverings can be removed once the pour has at least partially solidified so as to join horizontal steel beams 80. Optionally, and also before the pour has hardened, horizontal steel beams 80 can be inserted at various depths in the excavation, connecting two or more vertical columns 72 together. These steel beams 80 can thus provide additional confinement and shear reinforcement to the walls 10 by joining the walls 10 via their columns 72, thereby serving as intermediate foundations when necessary, and effectively creating one large structure whose structural inertia is difficult to overcome by earth forces.

The steel beams 80 may be installed as described herein. First, the beams 80 are lowered in the excavation to the appropriate depth, and then each end is welded or bolted into position against the corresponding column 72, or against the wall 10. Alternatively, the beams 80 can be installed by drilling after the pour has solidified by leaving a marker such as a steel tube in the wall 10 and/or installing a marker. Preferably also, reinforcing rods or vertical anchors 50 can be installed into the walls 10 for additional stability, as explained above.

It can thus be appreciated how the configuration of wall 10, beam 80, column 72 can allow for the execution of deep excavation to condition and densify the earth in between the walls 10, with the aim of achieving a stable and global combined wall and earth volume which resists liquefaction and adjacent ground displacement. Thus, it is understood that if a mass of earth around the structure displaces, this configuration of retaining walls 10 may prevent the mass contained within them from displacement, and will further advantageously significantly reduce any displacement of the structure itself.

Further optionally, at least one foundation beam 90 is laid atop and across the retaining walls 10 for providing a foundational support for the structure to be eventually mounted thereon. The foundation beam 90 is preferably any beam (i.e. I-beam, H-beam, Z-beam, reinforced concrete beam, pre-cast or not, cast-in-place reinforced concrete beam, etc.). The foundation beam 90 is preferably anchored into the walls 10 with suitable vertical or horizontal anchoring.

Finally, the excavated area between the walls 10 is backfilled with suitable conditioned earths and/or materials, and the backfilled materials can be progressively densified and conditioned for stability against liquefaction.

Figure 17:
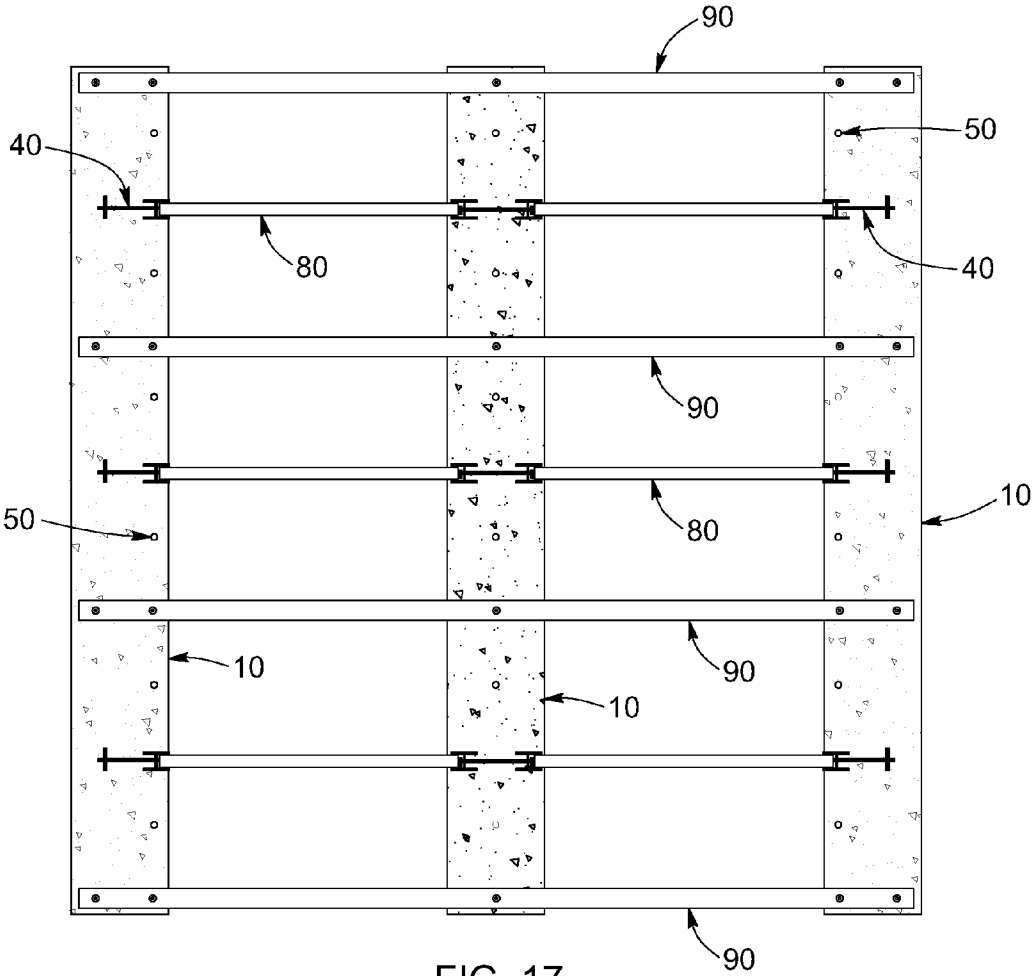
FIG. 17 is a schematic plan view of the multiple retaining walls of FIG. 16.

FIG. 17 exemplifies the configuration shown in FIG. 16, shown in a plan view (i.e. from on top). Multiple foundation beams 90 are shown across the walls 10. The welded or bolted steel beams 80 are shown connected to their anchors 40, which are secured in the walls 10. The vertical anchors 50 are shown as descending into the walls 10. Thus it is now apparent how multiple foundation beams 90, when laid across multiple retaining walls 10, can support a structure to be erected thereon.

Figure 19:
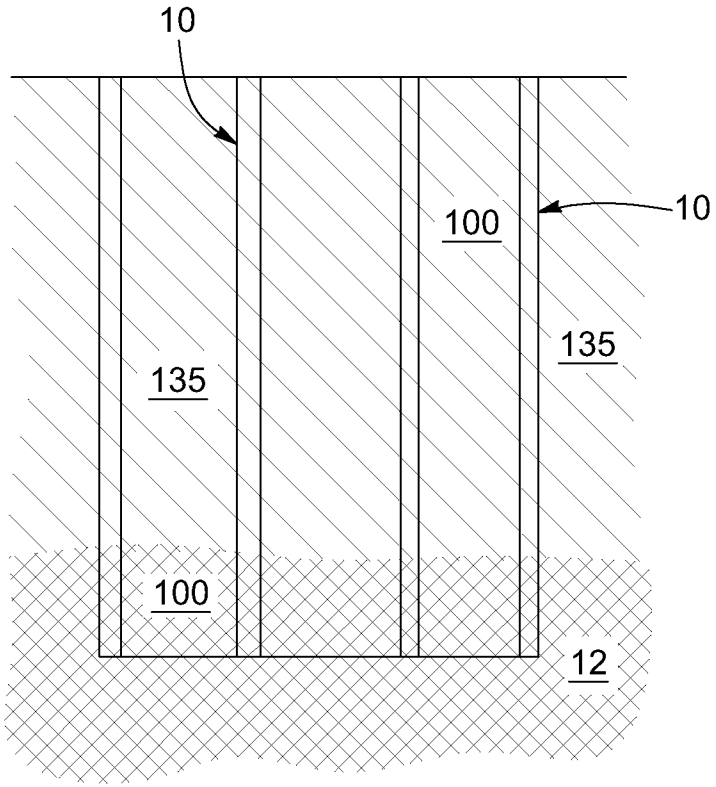
FIG. 19 is a schematic elevational view of the cellular retaining walls of FIG. 18.
Figure 18:
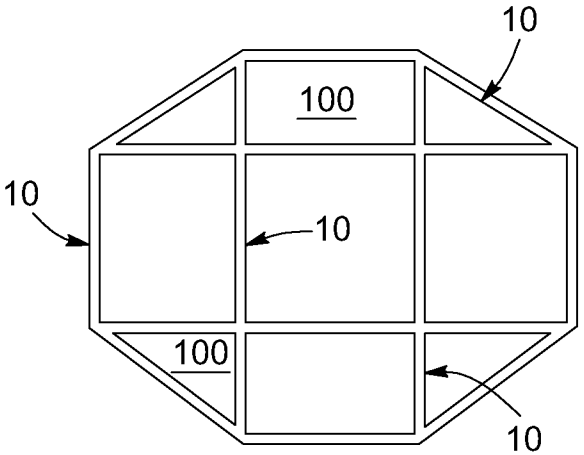
FIG. 18 is a schematic plan view of cellular retaining walls used in deep foundations placed in difficult earth conditions, according to an optional configuration of the invention.

FIGS. 18 and 19 provide yet another example of a configuration of multiple retaining walls 10, in both a plan (i.e. from on top) and side elevational views. These "cellular" or "crib" like structures may be suitable in difficult earth conditions and allow for earth pressure equalization in and/or by each independent cell 100. It may also useful when environmental or earth contaminants need to be isolated from one cell 100 to another 100. The bottom of the structure is preferably placed in impervious and/or solid earth 12. The remainder of the structure can be placed in difficult, more porous earths 135. The different positioning of the bottom and the rest of the structure allows for provision of stability and/or pollution control.

Optionally, each cell 100 is created by intersecting walls 10, where each wall 10 can be created as described above. Each cell 100 can vary from another, which can mean that each cell 100 can be excavated to a different depth, can contain a different earth and/or material, can be anchored and/or supported differently, etc. In one possible configuration, adjacent cells 100 contain a liquid such as sea water, for example. The adjacent cells 100 are hydraulically connected such that as the level of sea water raises in one cell 100, both cells 100 automatically adjust to a new level. It is thus apparent how adjacent cells 100 can automatically and rapidly adapt to changes in water level, which provides stability for any structure mounted thereon. As another example, pressurization units in each cell 100 can automatically and continually adjust the pressure and/or level in each cell 100 so as to redistribute the loads felt therein, thereby keeping any structure mounted thereon in a stress-free horizontal position. It is also understood how this same automatic adjustment can be achieved with earths at various levels or densifications.

Figure 20:
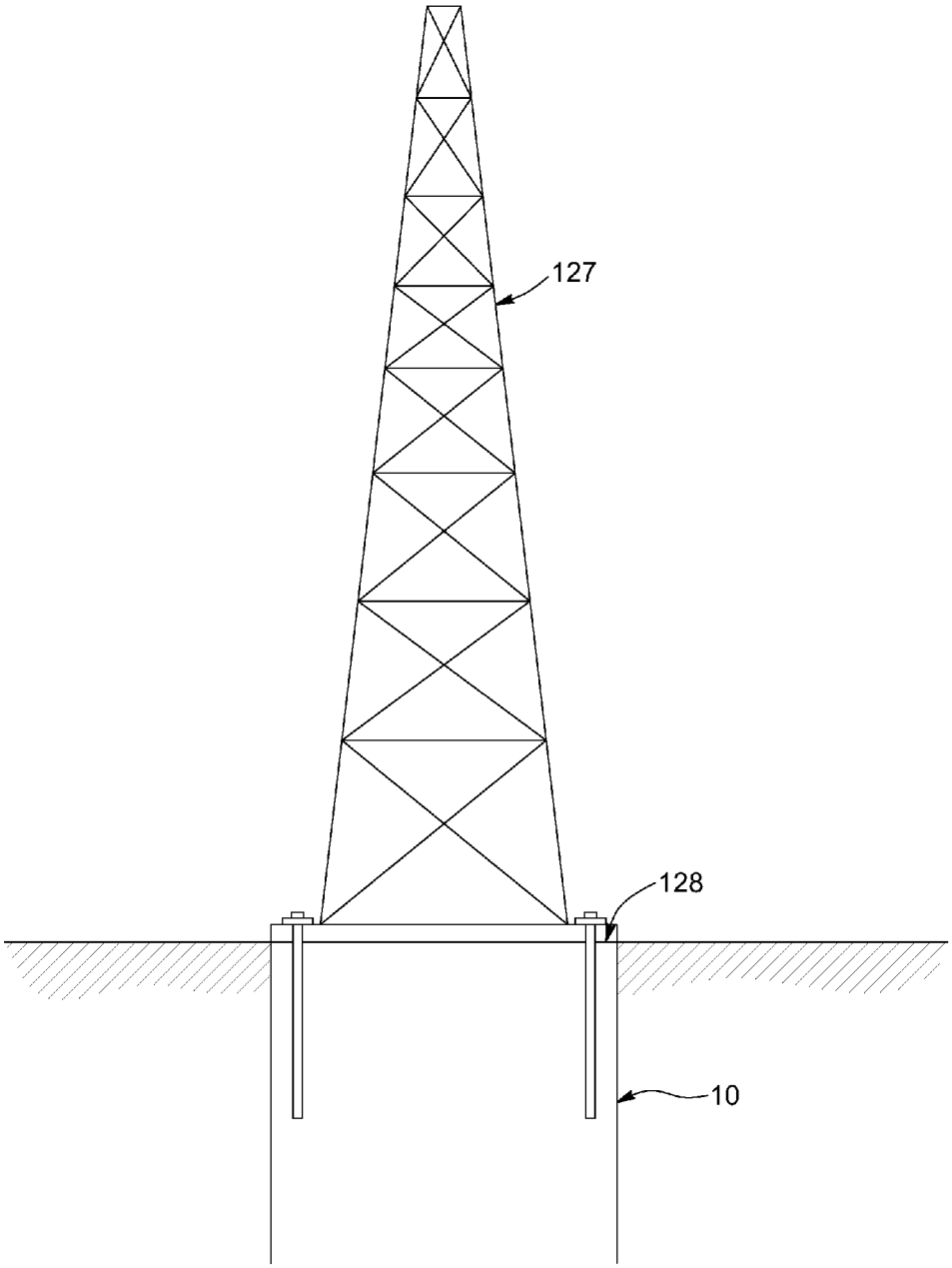
FIG. 20 is a schematic plan view of a structure mounted to a retaining wall, according to an optional configuration of the invention.

FIG. 20 provides an example of another purpose that the retaining wall 10 can serve. The wall 10 can define the top foundation surface 128, which can support a vertical structure 127 affixed thereto. The foundation surface 128 can also define a pathway upon which vehicles or equipment can circulate. In one possible configuration, the vertical structure 127 can be anchored to two or more retaining walls 10.

Figure 21:
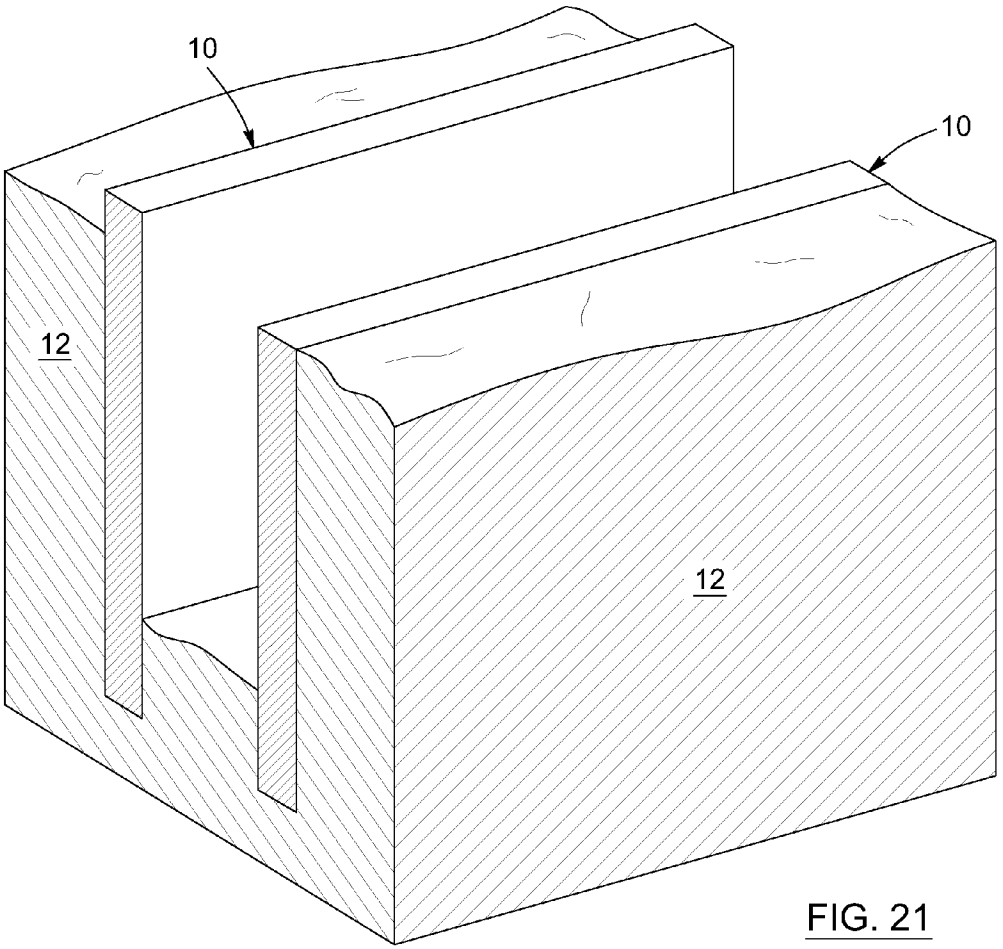
FIG. 21 is a schematic perspective view of two retaining walls securing earth from an excavation site, according to an optional configuration of the invention.

FIG. 21 provides another example of a configuration of retaining walls 10. Two retaining walls 10 can be used to retain the earth 12 from an excavated site on both sides of the excavation. Each wall 10 may be identical, or may also vary. For example, the height of one wall 10 can be greater than the other. Such walls 10 can also be used to enclose an excavated site, the walls in such a configuration forming a rectangular or other closed shape and connected to each other accordingly.

Furthermore, the method and system provide certain advantages which may allow for the formation of a retaining wall in an effective, quick, and economical manner. Furthermore, the present method allows a retaining wall 10 to be formed with less noise and more quickly than known methods, which advantageously allows the retaining wall 10 to be created at night without disturbing residents in surrounding areas. In many instances, the retaining wall 10 can be poured in about 2 hour's time. The cost-savings of the retaining wall 10 may be further improved because the retaining wall 10 can be made from low resistance concrete, which is relatively less expensive than other types of concrete.

With many conventional retaining walls, all the earth charges acting against the wall must be resisted by elements that are independent of the wall, such as anchors, piles, etc. The repeated cycles of compaction/excavation, in contrast, can allow for the formed retaining wall to stand on its own, and can adequately resist horizontal and moment forces. The manner in which compaction can be formed, such as with tools already on site, allows for the compaction to be localized, or only applied where necessary, further reducing operation times and costs. Such compaction can advantageously accomplish two functions: 1) stabilize the earth during excavation which improves excavation times and safety, and 2) densify the earth adjacent to the wall to be formed, which improves the resistance of the retaining wall which is formed.

Yet another advantage of the retaining wall 10 formed by the method is its thickness. A thick concrete wall 10 can act as a thermal insulator, which in cold climates reduces the likelihood of the earth freezing, and thus avoiding potential stresses caused by the freeze/thaw cycle in the retained earth. Indeed, the general minimum width of the wall 10 may be sufficient to prevent frost penetration behind the wall 10. This is in contrast to a retaining wall made of metal sheet piles, which acts as a thermal conductor and transmits cold into the earth being retained.

Such a thick, insulating wall can be made partially because of the compaction performed before and during excavation, which stabilizes adjacent earth columns, thereby reducing charges acting against the wall. This compaction and attendant earth stabilization can allow for the use of concrete having a lower resistance value, which is usually cheaper than other types of concrete.

Furthermore, compaction of the earth provides advantages such as increased earth density and stability that are not possible with known compaction techniques such as heavy rollers, for example, which are not appropriate for excavation purposes.

The method also advantageously allows workers on site to adjust rapidly to unknown earth conditions and/or obstacles because the repeated use of compaction with excavation allows workers to clear an excavated section before dealing with a new excavated area, thus improving wall 10 stability and allowing the workers to adapt to on-site earth conditions. Workers can thus quickly and easily compensate for different factors and stresses by quickly adding anchoring or moment compensation, for example, when required. Equally advantageously, the compaction/excavation performed may allow for vertical, horizontal and/or grouted anchors to be easily inserted into the wall 10 and to be pre-stressed if required.

Another factor which assists with on-site compensation and correction is the optionally large width of the retaining wall 10. In contrast to conventional walls, where it is often difficult to excavate deeper once the wall is in place, the large top foundation surface allows for the support of vehicles and other equipment on the wall 10, which can permit a crew to drill through the retaining wall 10 to sink another wall lower down, to pump out water, to make injections of material, or to do any other work required. Such a top foundation can also allow for the support of a vertical structure, thereby reducing the need for base support having a very large width and thus being expensive to create.

The solid concrete retaining wall 10 may provide excellent water impermeability qualities over the known methods of using sheet piles and/or Berlin walls, which have junctions and can allow leakage. This is particularly advantageous when the walls 10 intersect to form cells 100, as described above, thus allowing the cellular structure to separate pollutants, liquids, earths, etc. as required.

Furthermore, the wall 10 can be easily created on sites where a railway or road embankment has failed, and where there is not enough room to operate known systems. The wall 10 can be built to stabilize the earth mass which may be in a critical state after the slide or failure, and to reinforce the earth being retained, thus reducing the possibility of that embankment failing again.

The wall 10 described above can also be installed in areas where there is a desire to avoid trespassing on an adjacent property lot. The wall 10 may also be suitable for cases where there is an uneven underground rock formation that cannot be bypassed or removed. The adaptability of the concrete pour allows the wall 10 to rest stably on these uneven formations and to still provide sufficient retention to the earth.

In addition, multiple retaining walls 10 according to come configurations can provide significant stability to a vast excavated area without having to create and pour a massive retaining wall which may cause earth liquefaction and very high localised loads. Such a spaced-out structure advantageously allows for the placement and installment of foundation beams 90 across the walls 10, thereby providing additional cross-support to any structure erected thereon.

The retaining wall 10 may also provide the following advantages, although other advantages and benefits may also be possible: 1) it can be a temporary or permanent structure which conforms to the applicable code as well as to technical engineering design criteria; 2) it can serve as a dam for underground seepage so as to seal in or enclose rivers with minimal environmental impact; 3) it serves to stabilize unstable slopes and allow for their rehabilitation; 4) instabilities along railroad and road embankments may be rapidly and feasibly brought under control and made stable; 5) it can be installed without obstructions to existing property lines; 6) it can be used with most earths and/or highly fractured rock in unsaturated or below water table conditions; 7) it can be made from a wide range of concrete strengths ranging from about 60

MPa to less than about 1 Mpa; 8) it can be reinforced with either steel, plastic, or rope bar cages, and/or mesh or plastic steel fibres; 9) it can incorporate impervious plane sheeting with welded or glued anchoring heads which facilitate concrete bonding; 10) the concrete used for the wall may contain additives to enhance air entrapment, impermeability, fluidity and workability, early strength, etc.; 11) the concrete can be a suitable mixture of cement sand, gravel, and water in various proportions or be made of cement grout and/or cobbles; 12) it can incorporate piles and/or anchoring rods introduced prior or after the concrete pour on the upstream, central and/or downstream segments of the walls so as to further promote stability of the wall; 13) piles and/or pressure grouted vertical or inclined anchor rods may be used in combination with concrete to advantageously meet the specific ground and loading conditions; 14) reinforced earth may be used in conjunction with the retaining wall to improve the retention of the earth and the imposed surcharges; 15) etc.

Of course, numerous modifications could be made to the above-described configurations without departing from the scope of the invention, as defined in the appended claims.

The invention claimed is:

1. A method for forming a cementitious retaining wall, the method comprising the steps of:

a) defining on an earth surface an outline of the wall to be formed, the outline delimiting an area of earth to be excavated;

b) compacting the area, thereby densifying the earth underneath and adjacent to the area;

c) excavating the earth from the area compacted in step b) to an initial depth, thereby creating a wall cavity, the wall cavity comprising a bottom surface and side surfaces;

d) compacting the bottom surface of the wall cavity and subsequently excavating the earth from the compacted bottom surface;

e) repeating step d) until a final depth of the wall cavity is reached; and f) filling at least part of the wall cavity with a cementitious material so as to form the retaining wall.

2. A method according to claim 1, wherein compacting in step b) and step d) comprises applying a vibrational force.

3. A method according to claim 2, wherein the vibrational force is applied between an acceleration of about 0.5 g to about 5 g.

4. A method according to claim 2, comprising applying the vibrational force with a vibratory plate.

5. A method according to claim 4, comprising a step of interchanging the vibratory plate with a digging tool mounted to a hydraulic circuit.

6. A method according to claim 1, wherein step b) comprises compacting the earth adjacent to the area.

7. A method according to claim 1, wherein step c) comprises supporting the side surfaces with a retention structure.

8. A method according to claim 7, wherein step c) further comprises supporting the side surfaces with the retention structure while simultaneously excavating.

9. A method according to claim 7, wherein the retention structure is a steel caisson.

10. A method according to claim 1, wherein step b) further comprises compacting the area until the earth underneath the area obtains a percent compaction of maximum density between about 90% to about 100%.

11. A method according to claim 1, wherein the initial depth is between about 2 m and about 3 m.

12. A method according to claim 1, wherein the final depth is between about 4 m and about 12 m.

13. A method according to claim 1, wherein the outline of the wall has a width between about 1 m and about 6 m.

14. A method according to claim 1, wherein step f) comprises anchoring the formed retaining wall in a volume of the earth adjacent to the wall cavity.

15. A method according to claim 1, wherein steps c) and d) comprise excavating the earth by applying jets of fluid so as to create a slurry and removing the slurry from the wall cavity.

* * * * *